US010170261B2

(12) United States Patent
Tashima et al.

(10) Patent No.: US 10,170,261 B2
(45) Date of Patent: Jan. 1, 2019

(54) CONTACT DEVICE AND ELECTROMAGNETIC CONTACTOR USING SAME

(71) Applicant: FUJI ELECTRIC FA COMPONENTS & SYSTEMS CO., LTD., Tokyo (JP)

(72) Inventors: Yuki Tashima, Kounosu (JP); Kouetsu Takaya, Kounosu (JP); Hideo Adachi, Fukaya (JP); Yasuhiro Naka, Kitamoto (JP); Yuya Sakurai, Kounosu (JP); Koujun Konishi, Kounosu (JP)

(73) Assignee: FUJI ELECTRIC FA COMPONENTS & SYSTEMS CO., LTD., Tokyo (JP)

( * ) Notice: Subject to any disclaimer, the term of this patent is extended or adjusted under 35 U.S.C. 154(b) by 0 days.

(21) Appl. No.: 15/459,140

(22) Filed: Mar. 15, 2017

(65) Prior Publication Data

US 2017/0358413 A1 Dec. 14, 2017

(30) Foreign Application Priority Data

Jun. 14, 2016 (JP) ..... 2016-117918

(51) Int. Cl.
*H01H 9/00* (2006.01)
*H01H 50/54* (2006.01)
(Continued)

(52) U.S. Cl.
CPC ..... *H01H 50/541* (2013.01); *H01H 50/20* (2013.01); *H01H 50/36* (2013.01);
(Continued)

(58) Field of Classification Search
CPC ..... H01H 50/54; H01H 50/64; H01H 50/541; H01H 50/641
(Continued)

(56) References Cited

U.S. PATENT DOCUMENTS 2,783,340 A * 2/1957 Davies ..... H01H 9/04 174/153 R
3,339,161 A * 8/1967 Conner ..... H01H 50/22 200/243

(Continued)

FOREIGN PATENT DOCUMENTS

EP 2365508 A1 9/2011
JP 2011-187333 A 9/2011

OTHER PUBLICATIONS

Europe Patent Office, "Search Report for European Patent Application No. 17160997.7," dated Oct. 5, 2017.

*Primary Examiner* — Shawki S Ismail
*Assistant Examiner* — Lisa N Homza
(74) *Attorney, Agent, or Firm* — Manabu Kanesaka

(57) ABSTRACT

The contact device includes a main contact mechanism that includes a pair of main fixed contacts and a main movable contact elastically supported by a movable shaft and disposed to be contactable with and separable from the pair of main fixed contacts, an auxiliary contact mechanism that includes a pair of auxiliary fixed contacts and auxiliary movable contacts disposed in an auxiliary contact holding member connected to the movable shaft so as to be contactable with and separable from the pair of auxiliary fixed contacts, and a contact housing portion that houses the main contact mechanism and the auxiliary contact mechanism. The movable shaft has a main contact support portion supporting the main movable contact and an auxiliary contact support portion supporting the auxiliary contact holding member. The main contact support portion and the auxiliary contact support portion are connected to each other via the auxiliary contact holding member.

20 Claims, 25 Drawing Sheets

(51) Int. Cl.
*H01H 50/20* (2006.01)
*H01H 50/36* (2006.01)
*H01H 50/56* (2006.01)
*H01H 1/66* (2006.01)
*H01H 50/02* (2006.01)

(52) U.S. Cl.
CPC ..... *H01H 50/546* (2013.01); *H01H 50/56* (2013.01); *H01H 1/66* (2013.01); *H01H 2050/025* (2013.01); *H01H 2235/01* (2013.01)

(58) Field of Classification Search
USPC ..... 335/203
See application file for complete search history.

(56) References Cited

U.S. PATENT DOCUMENTS 3,898,596 A * 8/1975 Richards ..... H01H 3/60 200/250
3,942,143 A * 3/1976 Pollmann ..... H01H 50/541 335/132
4,899,120 A * 2/1990 Ohtake ..... H01H 9/0264 335/132
5,424,700 A * 6/1995 Santarelli ..... H01H 1/06 335/126
5,680,084 A 10/1997 Kishi et al.
5,703,551 A * 12/1997 Lefebvre ..... H01H 51/065 335/126
5,892,422 A * 4/1999 Montaigu ..... H01H 51/065 335/126
6,049,263 A * 4/2000 Vilou ..... H01H 51/065 290/38 R
6,377,143 B1 * 4/2002 Zhou ..... H01H 50/546 218/154
6,943,654 B2 * 9/2005 Zhou ..... H01H 9/563 335/106
7,196,434 B2 * 3/2007 Zhou ..... H01H 9/563 307/131
7,317,264 B2 * 1/2008 Kinsella ..... H01H 9/563 307/139
8,198,964 B2 6/2012 Yoshihara et al.
9,396,898 B2 * 7/2016 Kinsella ..... H01H 50/90
9,590,536 B2 * 3/2017 Kinsella ..... H02P 1/26
2004/0169976 A1 * 9/2004 Zhou ..... H01H 9/563 361/93.1
2011/0221548 A1 9/2011 Yoshihara et al.
2013/0127571 A1 * 5/2013 Takaya ..... H01H 9/443 335/201
2015/0015350 A1 * 1/2015 Tachikawa ..... H01H 1/66 335/131
2015/0022292 A1 * 1/2015 Tachikawa ..... H01H 50/54 335/131
2015/0248983 A1 * 9/2015 De Barros Albuquerque ..... H01H 71/08 335/133
2016/0049273 A1 * 2/2016 Jang ..... H01H 47/10 335/192

* cited by examiner

CONTACT DEVICE AND ELECTROMAGNETIC CONTACTOR USING SAME

CROSS REFERENCE TO RELATED APPLICATIONS AND INCORPORATION BY REFERENCE

This application claims benefit of priority under 35 USC 119 based on Japanese Patent Application No. 2016-117918 filed on Jun. 14, 2016, the entire contents of which are incorporated by reference herein.

TECHNICAL FIELD

The present invention relates to a contact device which opens and closes a current path, and an electromagnetic contactor using the contact device.

BACKGROUND ART

In the related art, for example, JP2011-187333 A discloses a contact device which opens and closes a current path.

The contact device disclosed in JP2011-187333 A has a configuration in which a main contact mechanism and an auxiliary contact mechanism are arranged in series, and in which a movable contact of the main contact mechanism and a movable contact of the auxiliary contact mechanism are supported by a connection shaft connected to a movable iron core of an electromagnetic device. In general, the connection shaft is formed of a conductive metal material, and the movable iron core is configured to include an iron core.

For example, in a case where deposition occurs in the main contact mechanism of the contact device, the deposition can be detected by the auxiliary contact mechanism.

SUMMARY OF THE INVENTION

Incidentally, according to the contact device disclosed in JP2011-187333 A, in the main contact mechanism, a movable contact is attached to and detached from a pair of fixed contacts, thereby forming and blocking the current path. In a case where power supplied to the current path is several hundred volts and several tens of amperes or higher, a voltage applied to the movable contact reaches the movable iron core through the connection shaft. Therefore, it is necessary to improve insulating performance of not only a main contact housing portion for housing the main contact mechanism but also an electromagnet housing portion for housing the electromagnetic device. Consequently, there is a problem in that an entire configuration of an electromagnetic switch including the contact device has to increase in size.

Therefore, the present invention is made in view of the problem in the related art disclosed in JP2011-187333 A described above, and an object thereof is to provide a contact device and an electromagnetic contactor using the same, in which a voltage applied to at least a main contact mechanism can be prevented from being applied to an electromagnetic device.

In order to achieve the above-described object, according to an aspect of the present invention, there is provided a contact device including a main contact mechanism that includes a pair of main fixed contacts separated from each other and a main movable contact elastically supported by a movable shaft and disposed so as to be contactable with and separable from the pair of main fixed contacts, an auxiliary contact mechanism that is disposed at a different position from a position of the main contact mechanism, and that includes a pair of auxiliary fixed contacts separated from each other and an auxiliary movable contact disposed in an auxiliary contact holding member connected to the movable shaft so as to be contactable with and separable from the pair of auxiliary fixed contacts, and a contact housing portion that houses the main contact mechanism and the auxiliary contact mechanism. The movable shaft includes a main contact support portion for supporting the main movable contact and an auxiliary contact support portion for supporting the auxiliary contact holding member, the main contact support portion and the auxiliary contact support portion being divided from each other. The main contact support portion and the auxiliary contact support portion are connected to each other via the auxiliary contact holding member.

In addition, according to another aspect of the present invention, there is provided an electromagnetic contactor including the contact device having the above-described configuration. The movable shaft is connected to a movable iron core, and the electromagnetic contactor includes an electromagnetic unit that moves the movable iron core.

According to the aspect of the contact device in the present invention, the main contact support portion that supports the main contact mechanism configuring the movable shaft and the auxiliary contact support portion that supports the auxiliary contact are connected to each other via the auxiliary contact holding member. Therefore, it is possible to prevent a high voltage from being applied to the auxiliary contact support portion by insulating the main contact support portion and the auxiliary contact support portion.

In addition, according to the aspect of the electromagnetic contactor in the present invention, it is possible to provide the electromagnetic contactor whose simple configuration can prevent a high voltage from being applied to the electromagnetic unit so as to minimize an overall configuration.

The object and advantages of the invention will be realized and attained by means of the elements and combinations particularly pointed out in the claims. It is to be understood that both the foregoing general description and the following detailed description are exemplary and explanatory and are not restrictive of the invention.

DETAILED DESCRIPTION

Figure 1:
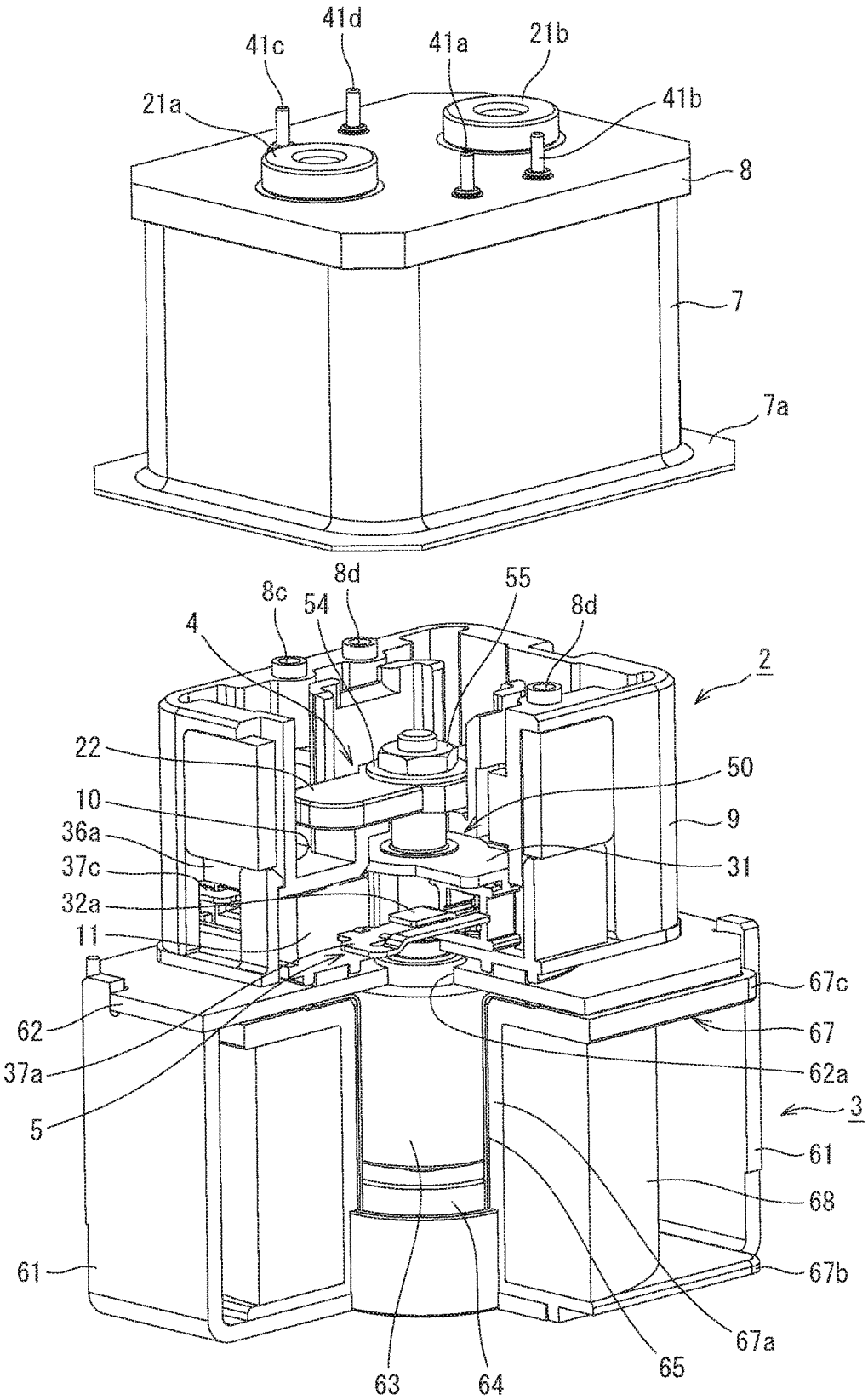
FIG. 1 illustrates a first embodiment of an electromagnetic contactor having a contact device according to the present invention, and is a perspective view of a contact housing portion and an electric potential magnetic housing portion which are partially cut out in a state where a contact housing case is detached.

An embodiment according to the present invention will be described with reference to the drawings. In the following description of the drawings, the same or similar reference numerals will be given to the same or similar elements. However, the drawings illustrate a schematic configuration, and thus, it should be noted that a relationship between the thickness and a planar dimension or a ratio between respective layer thicknesses is different from the actual ratio. Therefore, a specific thickness or dimension should be determined based on the following description. In addition, as a matter of course, the drawings mutually include elements whose dimensional relationships or ratios are different from each other.

In addition, embodiments described below provide an example of a device and a method for embodying the technical idea of the present invention. In the technical idea of the present invention, a material, shape, structure, and arrangement of configuration components are not specified by the following embodiments. The technical idea of the present invention can be modified in various ways within the technical scope defined in claims.

Hereinafter, the embodiments of an electromagnetic contactor including a contact device according to the present invention will be described.

First Embodiment

Figure 2:
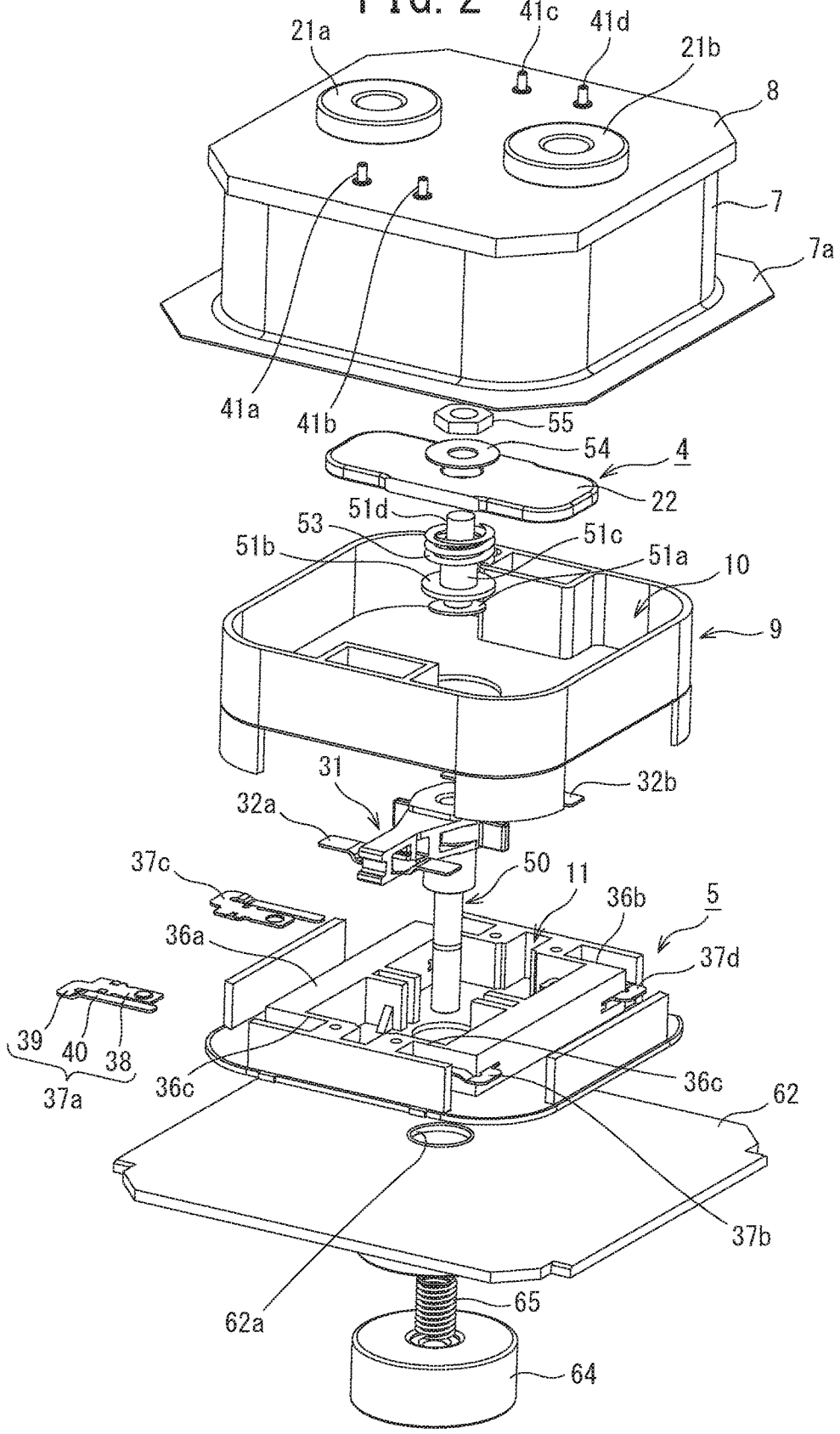
FIG. 2 is an exploded perspective view of the contact device according to the first embodiment.
Figure 3:
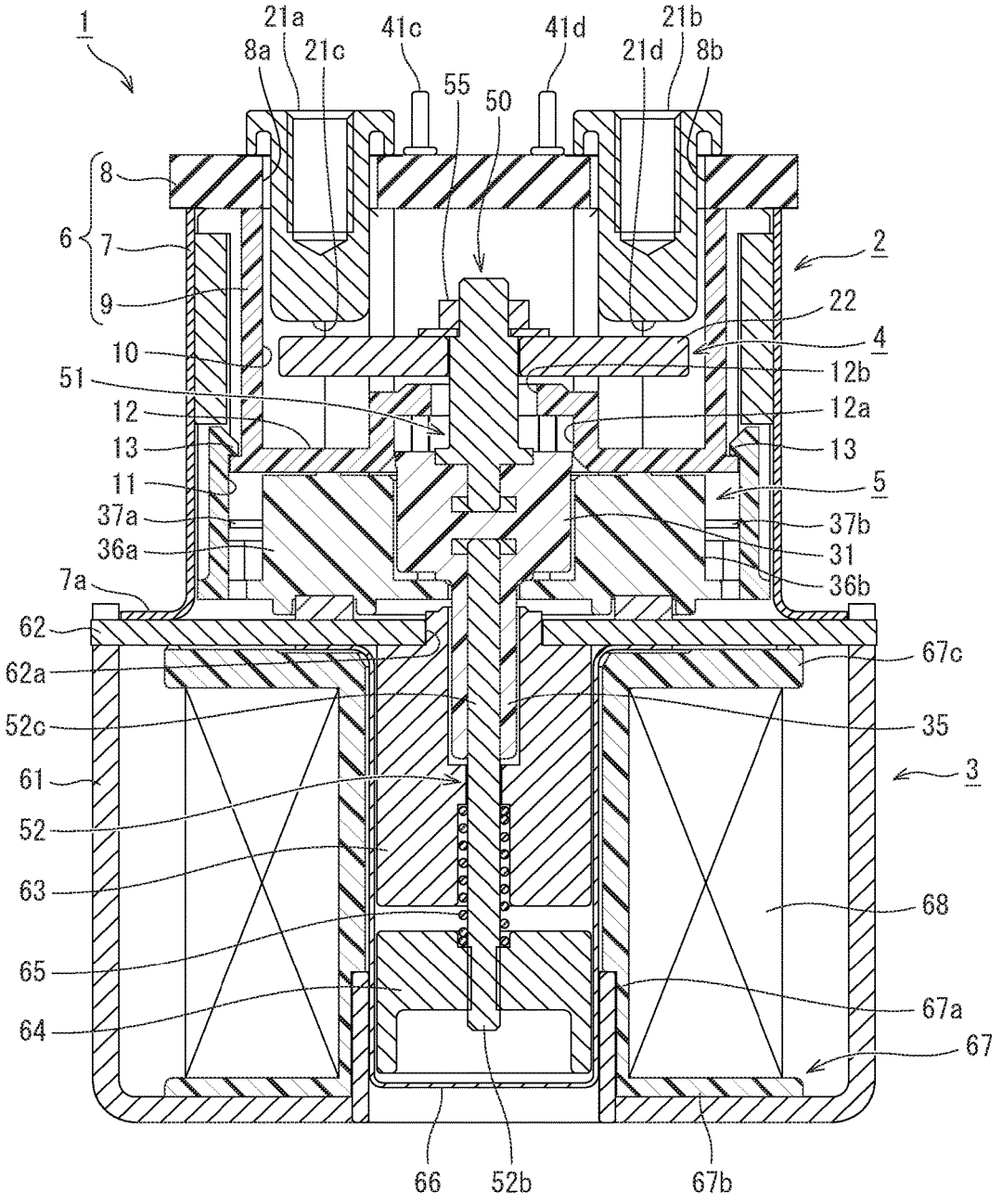
FIG. 3 is a sectional view illustrating a main fixed contact position of a main contact mechanism according to the first embodiment.

As illustrated in FIGS. 1 to 3, an electromagnetic contactor 1 includes a contact device 2 and an electromagnetic unit 3 that drives the contact device 2.

The contact device 2 includes a contact housing portion 6 that houses a main contact mechanism 4 and an auxiliary contact mechanism 5. The contact housing portion 6 is configured to include an outer polygonal tubular body 7 whose both opening ends are relatively high and which is formed of a metal material, a lid 8 which closes one opening end of the outer polygonal tubular body 7 and which is formed of an insulating material, and an inner polygonal tubular body 9 which is disposed on an inner peripheral side of the outer polygonal tubular body 7 and which is formed of an insulating material.

The outer polygonal tubular body 7 is formed in a rectangular shape in a plane view, and has a flare-shaped flange 7*a* formed in an end portion opposite to the lid 8.

The lid 8 is formed in a rectangular shape which is larger than an outer shape dimension of the outer polygonal tubular body 7. The lid 8 has through-holes 8*a* and 8*b* which individually support a pair of main fixed contacts of the main contact mechanism 4 (to be described later) while maintaining a predetermined interval in a longitudinal direction. In addition, the lid 8 has through-holes (not illustrated) which individually cause four external connection terminals of the auxiliary contact mechanism 5 (to be described later) to be exposed outward two by two while maintaining a predetermined interval in a lateral direction.

In the inner polygonal tubular body 9, a main contact housing portion 10 which houses the main contact mechanism 4, and an auxiliary contact housing portion 11 which houses the auxiliary contact mechanism 5 and which is lower than the main contact housing portion 10 are arranged in series in an axial direction.

The main contact housing portion 10 and the auxiliary contact housing portion 11 are divided by a partition wall 12 formed on an inner peripheral surface opposite to the lid 8 across a central portion in the axial direction. The partition wall 12 has a recess 12*a* which extends in the lateral direction so as to protrude to the opening end side and which has a U-shape in cross section. A through-hole 12*b* into which a movable shaft (to be described later) is inserted is formed in the central portion in the lateral direction of the recess 12*a*. The main contact housing portion 10 and the auxiliary contact housing portion 11 are integrated with each other by a snap fit portion 13.

The main contact mechanism 4 is configured to include a pair of main fixed contacts 21*a* and 21*b* separated from each other, and a main movable contact 22 supported so as to be contactable with and separable from the pair of main fixed contacts 21*a* and 21*b*.

The main fixed contacts 21*a* and 21*b* are held by being inserted into the through-holes 8*a* and 8*b* of the lid 8, and contact portions 21*c* and 21*d* formed in one end of the main fixed contacts 21*a* and 21*b* protrude into the main contact housing portion 10.

The main movable contact 22 is configured to include a rectangular plate body extending in the longitudinal direction of the main contact housing portion 10, and is supported by the movable shaft 50 (to be described later) so as to be contactable with and separable from the contact portion 21*c* and 21*d* of the main fixed contact 21*a* and 21*b* from a side opposite to the lid 8.

The auxiliary contact mechanism 5 includes an auxiliary contact holding member 31 which integrates a movable shaft (to be described later), a pair of auxiliary movable contacts 32*a* and 32*b* supported by the auxiliary contact holding member 31 and separated from each other, and two sets of auxiliary fixed contacts 33*a* and 33*b* facing the auxiliary movable contacts 32*a* and 32*b* and fixed inside the auxiliary contact housing portion 11 while being separated from each other.

Figure 5:
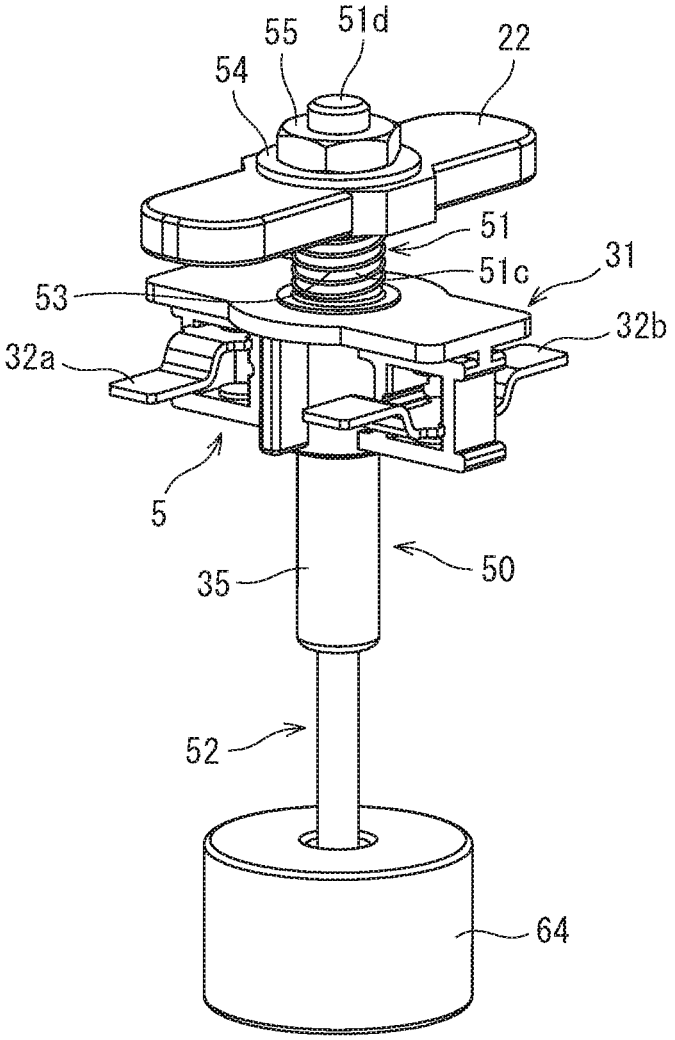
FIG. 5 is a perspective view illustrating a movable shaft according to the first embodiment.
Figure 6:
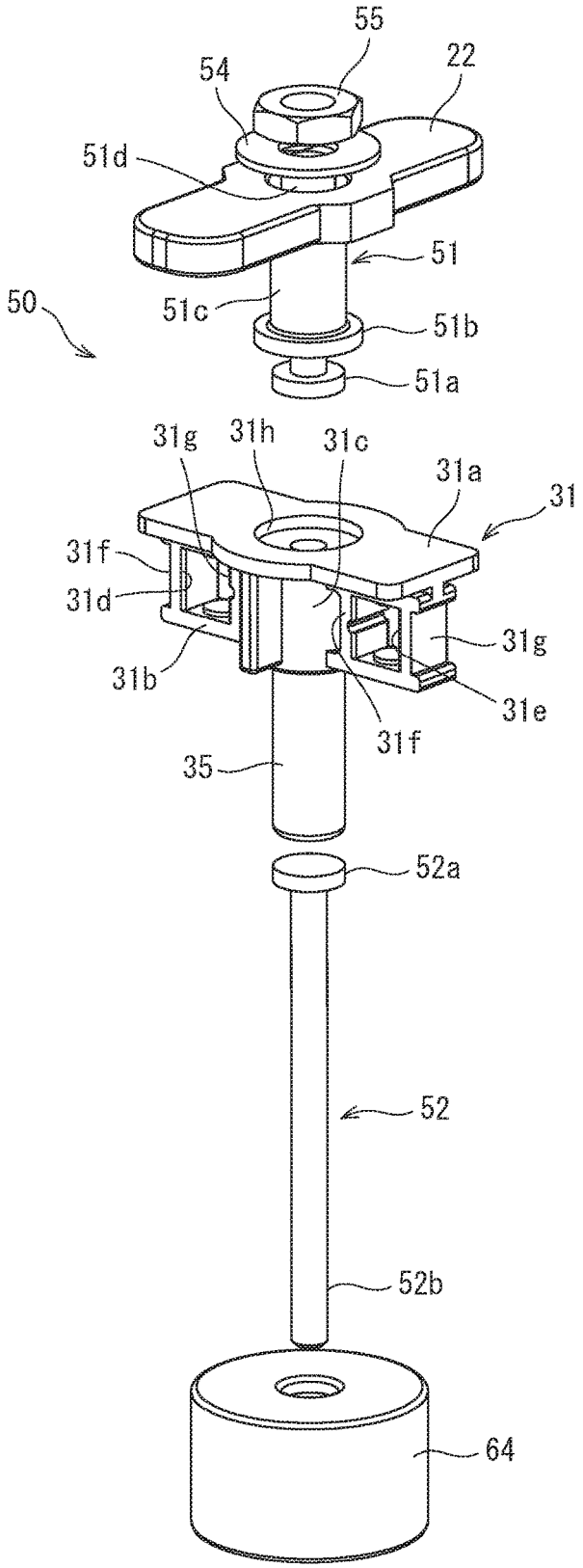
FIG. 6 is an exploded perspective view of the movable shaft in FIG. 4.

As illustrated in FIG. 6, the auxiliary contact holding member 31 includes a pair of upper and lower plates 31*a* and 31*b* separated from each other, a short columnar connection portion 31*c* which connects the plates 31*a* and 31*b* to each other at the central portion, and contact holders 31*d* and 31*e* formed outside the columnar connection portion 31*c*. The plates 31*a* and 31*b* are parallel to each other, and extend in a direction orthogonal to the main movable contact 22. Each of the contact holders 31*d* and 31*e* is formed in a polygonal tubular shape parallel to the axial direction of the main movable contact 22 by two mutually separated connection plates 31*f* and 31*g* connecting the plates 31*a* and 31*b* to each other. As illustrated in FIG. 5, the auxiliary movable contacts 32*a* and 32*b* are arranged inside the contact holders 31*d* and 31*e* by being individually pressed in one direction of upward and downward directions by a pressure spring 34. Here, as illustrated in FIG. 5, the auxiliary movable contact 32*a* held by the contact holder 31*d* is pressed upward, and the auxiliary movable contact 32*b* held by the contact holder 31*e* is pressed downward.

On the other hand, as illustrated in FIGS. 2 and 3, the auxiliary contact housing portion 11 has fixed contact holders 36*a* and 36*b* formed at positions facing both ends of the auxiliary movable contacts 32*a* and 32*b*. A pair of auxiliary fixed contacts 37*a* and 37*b*, and a pair of auxiliary fixed contacts 37*c* and 37*d* which have a contact facing a contact portion of the auxiliary movable contacts 32*a* and 32*b* are held in the fixed contact holders 36*a* and 36*b*. Here, the auxiliary movable contact 32*a* and the auxiliary fixed contacts 37*a* and 37*b* configure a normally closed contact (break contact), and the auxiliary movable contact 32*b* and the auxiliary fixed contacts 37*c* and 37*d* configure a normally open contact (make contact).

As illustrated in FIG. 2, each of the auxiliary fixed contacts 37*a* to 37*d* is formed in a substantially U-shape in a plane view by a contact plate 38 forming the contact, a folded-back portion 39 folded back from an outer end of the contact plate 38, and an elastic connection plate 40 extending inward from a distal end of the folded-back portion 39 so as to be parallel to the contact plate 38.

Here, the folded-back portion 39 is formed such that an interval between inner peripheral edges is set to a length fitted to a side wall 36*c* forming the contact housing portion (to be described later).

A lower end of external connection terminals 41*a* to 41*d* fixed to the lid 8 is in contact with each of the elastic connection plates 40 of the respective auxiliary fixed contacts 37*a* to 37*d*.

In addition, the movable shaft 50 supporting the main movable contact 22 of the main contact mechanism 4 is formed integrally with the auxiliary contact holding member 31 of the auxiliary contact mechanism 5. As illustrated in FIG. 6, the movable shaft 50 is divided into a main contact support portion 51 supporting the main movable contact of the main contact mechanism 4 and an auxiliary contact support portion 52 connecting the auxiliary contact holding member 31 and a movable iron core 64 of the electromagnetic unit 3 (to be described later) to each other. The main contact support portion 51 and the auxiliary contact support portion 52 are integrally connected to each other via the auxiliary contact holding member 31.

For example, the main contact support portion 51 is formed of a metal material in a rod shape. A flange 51*a* buried in the auxiliary contact holding member 31 is formed in one end of the main contact support portion 51 so as to protrude in a radial direction. A spring seat 51*b* whose diameter is larger than the diameter of the flange 51*a* is formed at a position separated to the other end side from the flange 51*a* so as to protrude in the radial direction.

The other end side of the main contact support portion 51 has a support rod 51*c* which is inserted into a through-hole 22*a* formed in the main movable contact 22 of the main contact mechanism 4 and which supports the main movable contact 22 so as to be movable in the axial direction. The other end side of a support rod 52*c* has a male screw 51*d* whose diameter is smaller than the diameter of the support rod 51*c*.

As illustrated in FIGS. 2 to 5, the main movable contact 22 is supported by the main contact support portion 51 so as to be movable. In order to support the main movable contact 22, the main contact support portion 51 is first inserted into a pressure spring 53 from a male screw 51*d* side, thereby bringing a lower end of the pressure spring 53 into contact with the spring seat 51*b*. In this state, the main contact support portion 51 is inserted into the through-hole 22*a* of the main movable contact 22 from a male screw 51*d* side, and the main movable contact 22 is pressed from above, thereby bringing the pressure spring 53 into a contracted state. In this state, a washer 54 is mounted thereon from the male screw 51*d* side, and subsequently, a nut 55 is screwed and fastened to the male screw 51*d*. In this manner, the main movable contact 22 is supported so as to be slidable in the axial direction in a state where predetermined contact pressure is secured by the pressure spring 53.

As illustrated in FIG. 6, the auxiliary contact support portion 52 is formed of a metal material in a rod shape, for example. One end of the auxiliary contact support portion 52 has a flange 52*a* buried in the auxiliary contact holding member 31, and the other end has a male screw 52*b*.

The male screw 52*b* is screwed to a female screw of the movable iron core 64 of the electromagnetic unit 3 (to be described later), and is connected to the movable iron core 64.

The main contact support portion 51 and the auxiliary contact support portion 52 are integrated with each other via the auxiliary contact holding member 31, thereby forming the movable shaft 50.

According to the present embodiment, when the movable shaft 50 is formed, the flange 51*a* and the spring seat 51*b* of the main contact support portion 51, and the flange 52*a* of the auxiliary contact support portion 52 are mounted inside a mold for performing resin molding on the auxiliary contact holding member 31. The flanges 51*a* and 52*a* are fixed to each other in a state where both of these are separated from each other. In this state, so-called insert molding is used in which a molten resin is injected into the mold at high pressure so as to be solidified. As illustrated in FIG. 5, the movable shaft 50 is configured as an insert-molded product in which the movable shaft 50 is molded integrally with the auxiliary contact holding member 31.

Figure 4:
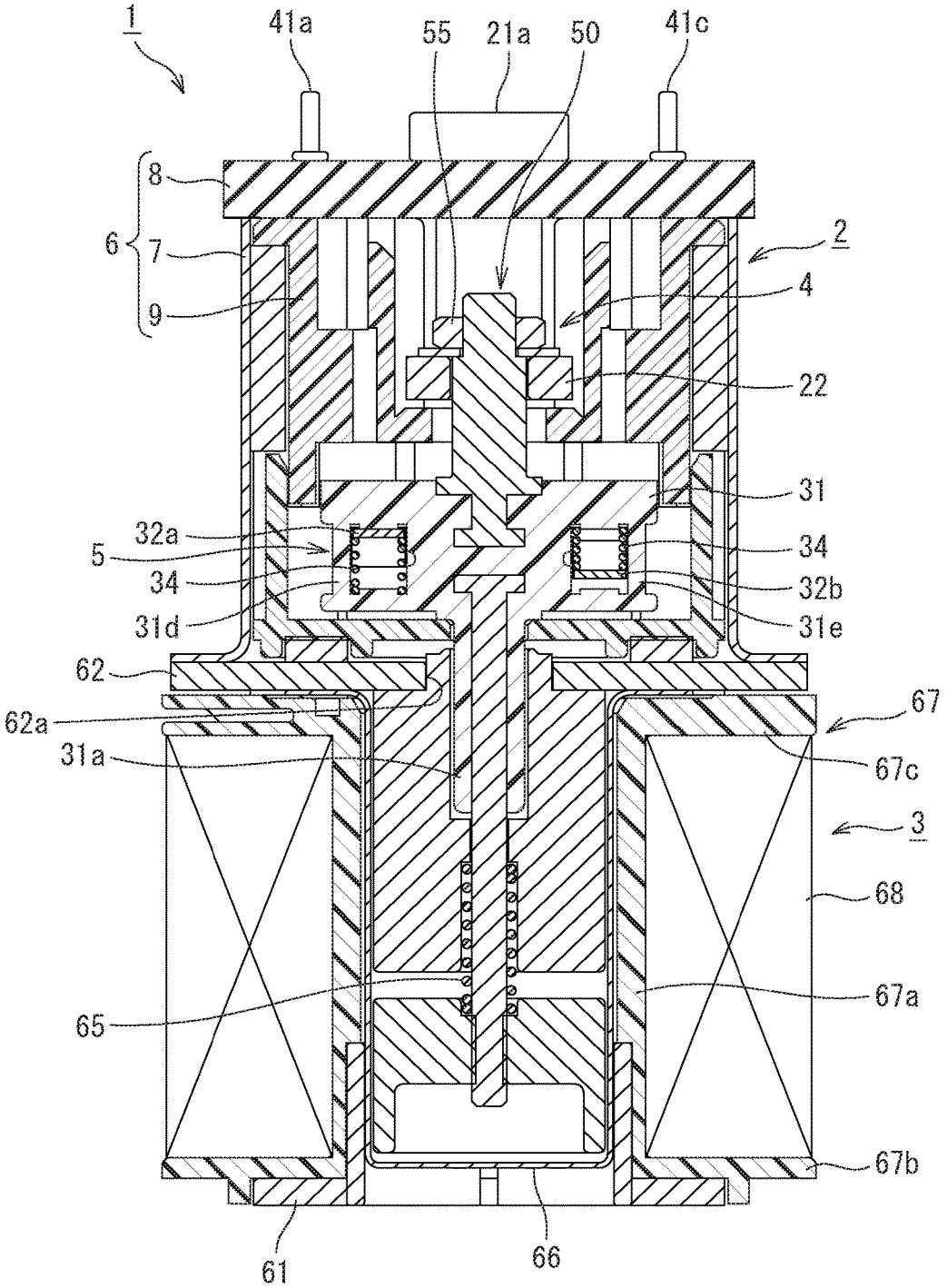
FIG. 4 is a sectional view illustrating an auxiliary contact holding member position of an auxiliary contact mechanism according to the first embodiment.

Therefore, as illustrated in FIGS. 3 and 4, the main contact support portion 51 is joined to the auxiliary contact holding member 31 in a relationship in which the flange 51*a* is buried in the columnar connection portion 31*c* and the upper surface of the spring seat 51*b* is flush with the upper surface of the plate 31*a*. In addition, the auxiliary contact support portion 52 is joined to the auxiliary contact holding member 31 in a relationship in which the flange 52*a* is buried in the columnar connection portion 31*c* and the support rod 52*c* connected to the flange 52*a* is buried in the central portion of a cylindrical extending portion 35 formed to protrude on the lower surface of the auxiliary contact support portion 52.

As illustrated in FIG. 3, the electromagnetic unit 3 has a U-shaped lower magnetic yoke 61 whose one end is open when viewed from the side, and a flat plate-shaped upper magnetic yoke 62 which connects the opening end of the lower magnetic yoke 61. A through-hole 62*a* is formed in the central portion of the upper magnetic yoke 62. A cylindrical fixed iron core 63 is fixedly disposed on the bottom surface side of the through-hole 62*a*. A cylindrical movable iron core 64 is disposed on a side opposite to the upper magnetic yoke 62 of the fixed iron core 63. The movable iron core 64 is biased in a direction away from the fixed iron core 63 by a return spring 65 interposed between the fixed iron core 63 and the movable iron core 64.

The fixed iron core 63 and the movable iron core 64 are covered with a cap 66 which is joined to the lower surface of the upper magnetic yoke 62 in an airtight state.

In addition, the flange 7*a* of the above-described outer polygonal tubular body 7 is joined to the upper surface of the upper magnetic yoke 62 in an airtight state, thereby forming the hermetically sealed contact device 2 in which the contact housing portion 6 and the cap 66 communicate with each other via the movable iron core through-hole 62*a* of the upper magnetic yoke 62. For example, the contact housing portion 6 and the cap 66 which are hermetically sealed are internally filled with arc extinguishing gas such as hydrogen.

A spool 67 is disposed on the outer periphery of the cap 66. As illustrated in FIGS. 3 and 4, the spool 67 includes a central cylindrical portion 67*a* into which the cap 66 is inserted, a lower flange 67*b* protruding outward in the radial direction from the lower end portion of the central cylindrical portion 67*a*, and an upper flange 67*c* protruding outward in the radial direction from the upper end portion of the central cylindrical portion 67*a*. A control coil 68 is wound in a housing space configured by the central cylindrical portion 67*a*, the lower flange 67*b*, and the upper flange 67*c* of the spool 67.

Next, an operation of the electromagnetic contactor 1 according to the first embodiment will be described.

First, for example, the main fixed contact 21*a* is connected to a power supply source for supplying a large current, and the main fixed contact 21*b* is connected to a load.

In this case, the control coil 68 in the electromagnetic unit 3 is in a non-excited state, that is, in a released state where an excitation force for raising the movable iron core 64 is not generated in the electromagnetic unit 3.

In the released state, the movable iron core 64 is biased in the downward direction away from the fixed iron core 63 by the return spring 65.

Accordingly, the main movable contact 22 configuring the main contact mechanism 4 connected to the movable iron core 64 via the movable shaft 50 is separated downward from the main fixed contacts 21*a* and 21*b* with a predetermined distance. Therefore, a current path between the main fixed contacts 21*a* and 21*b* is in an open state, and the main contact mechanism 4 is in a released state.

On the other hand, in the auxiliary contact mechanism 5, the movable iron core 64 is moved downward by the return spring 65. The movable shaft 50 connected to the movable iron core 64 is also moved downward. Therefore, as illustrated in FIGS. 3 and 4, the auxiliary contact holding member 31 connected to the movable shaft 50 is moved downward. Accordingly, in the auxiliary contact mechanism 5, due to contact pressure of the pressure spring 33, the auxiliary movable contact 32*a* is brought into a state where the auxiliary movable contact 32*a* is in contact with the auxiliary fixed contacts 37*a* and 37*b*. In this manner, the auxiliary fixed contacts 37*a* and 37*b* are brought into a normally closed state where both of these are electrically connected to each other. Conversely, the auxiliary movable contact 32*b* is brought into a state where the auxiliary movable contact 32*b* is separated upward from the auxiliary fixed contacts 37*c* and 37*d*. In this manner, the auxiliary fixed contacts 37*c* and 37*d* are brought into a normally open state where both of these are blocked.

Accordingly, in the auxiliary fixed contacts 37*a* and 37*b* of the auxiliary contact mechanism 5, the external connection terminals 41*a* and 41*b* are in elastic contact with the elastic connection plate 40. Accordingly, an operation detection circuit for detecting a connection state of the main contact mechanism 4 is connected to the upper end of the external connection terminals 41*a* and 41*b*. In this manner, it is possible to detect a closed state of the auxiliary movable contact 32*a* and an open state of the main contact mechanism 4.

Similarly, in the auxiliary fixed contacts 37*c* and 37*d*, the distal end of the external connection terminals 41*c* and 41*d* is in elastic contact with the elastic connection plate 40. Accordingly, a connection detection circuit for detecting a connection state of the main contact mechanism 4 is connected to the upper end of the external connection terminals 41*c* and 41*d*. In this manner, it is possible to detect an open state of the auxiliary movable contact 32*b* and an open state of the main contact mechanism 4.

If power is supplied to the control coil 68 of the electromagnetic unit 3 in the released state, the excitation force is generated in the electromagnetic unit 3, and the movable iron core 64 is pressed upward against a biasing force of the return spring 65. Ascending of the movable iron core 64 is stopped by the upper surface of the movable iron core 64 coming into contact with the lower surface of the fixed iron core 63.

In this way, since the movable iron core 64 ascends, the main movable contact 22 of the main contact mechanism 4 connected to the movable iron core 64 via the movable shaft 50 also ascends, and comes into contact with each of the main fixed contacts 21*a* and 21*b* by using the contact pressure of the pressure spring 53.

Therefore, the main contact mechanism 4 is brought into a closed state in which the large current of the power supply source is supplied to the load through the main fixed contact 21*a*, the main movable contact 22, and the main fixed contact 21*b*.

In the closed state of the main contact mechanism 4, the auxiliary movable contact 32*a* of the auxiliary contact mechanism 5 is separated from the auxiliary fixed contacts 37*a* and 37*b*, thereby bringing the auxiliary contact mechanism 5 into an open state. Therefore, the external connection terminals 41*a* and 41*b* are brought into a blocked state, thereby enabling the detection device connected between the external connection terminals 41*a* and 41*b* to detect a closed state of the main contact mechanism 4. Similarly, the auxiliary movable contact 32*b* of the auxiliary contact mechanism 5 comes into contact with the auxiliary fixed contacts 37*c* and 37*d*, thereby bringing the auxiliary contact mechanism 5 into a closed state. Therefore, the external connection terminals 41*c* and 41*d* are brought into an electrically connected state, thereby enabling the detection device connected between the external connection terminals 41*c* and 41*d* to detect a closed state of the main contact mechanism 4.

In this case, in the movable shaft 50 connected to the main movable contact 22 of the main contact mechanism 4, the main contact support portion 51 for holding the main movable contact 22 and the auxiliary contact support portion 52 for holding the auxiliary contact holding member 31 of the auxiliary contact mechanism 5 are joined to each other via the auxiliary contact holding member 31 formed of an insulating material. Therefore, even in a case where the main contact support portion 51 and the auxiliary contact support portion 52 are mutually formed of a conductive metal material, since the auxiliary contact holding member 31 is interposed between both of these, it is possible to reliably ensure insulation between the main contact support portion 51 and the auxiliary contact support portion 52.

Therefore, since a charging unit which receives high voltage application is housed inside only the contact device 2, the electromagnetic unit 3 side does not need a special insulating countermeasure such as a potting process using a resin, and a simple configuration can be adopted. In addition, an insulating distance between the movable iron core 64 or the magnetic yokes 61 and 62, and the control coil 68 can be shortened, thereby miniaturizing the electromagnetic unit 3. Accordingly, it is possible to miniaturize the overall electromagnetic contactor 1.

Moreover, the main contact support portion 51 and the auxiliary contact support portion 52 configuring the movable shaft 50 can be joined using the auxiliary contact holding member 31. Accordingly, it is no longer necessary to separately dispose a joining member for joining the main contact support portion 51 and the auxiliary contact support portion 52 to each other. Therefore, it is possible to simplify the overall configuration.

Furthermore, the main contact support portion 51 and the auxiliary contact support portion 52 configuring the movable shaft 50 are joined to the auxiliary contact holding member 31 by means of insert-molding, and all of these are integrally formed. Accordingly, it is possible to easily and very accurately form the movable shaft 50 including the auxiliary contact holding member 31.

In addition, the main contact support portion 51 configuring the movable shaft 50 is formed by being inserted into the auxiliary contact holding member 31. However, the flange 51*a* of the main contact support portion 51 is buried in the columnar connection portion 31*c*, and the spring seat 51*b* whose area is larger than the area of the flange 51*a* is also buried in a surface portion of the plate 31*a*. Accordingly, it is possible to reliably prevent the main contact support portion 51 from being tilted to the auxiliary contact holding member 31. Therefore, a long-term use can be sufficiently ensured.

In addition, the auxiliary contact holding member 31 has the cylindrical extending portion 35 for covering the auxiliary contact support portion 52. Accordingly, it is possible to reliably prevent the auxiliary contact support portion 52 from being tilted to the auxiliary contact holding member 31. Therefore, a long-term use can be sufficiently ensured.

Second Embodiment

Next, a second embodiment of the electromagnetic contactor having the contact device according to the present invention will be described with reference to FIGS. 7 and 8.

According to the second embodiment, the main contact support portion 51 and the auxiliary contact support portion 52 which configure the movable shaft 50 are joined to the auxiliary contact holding member 31 by using an adhesive.

Figure 7:
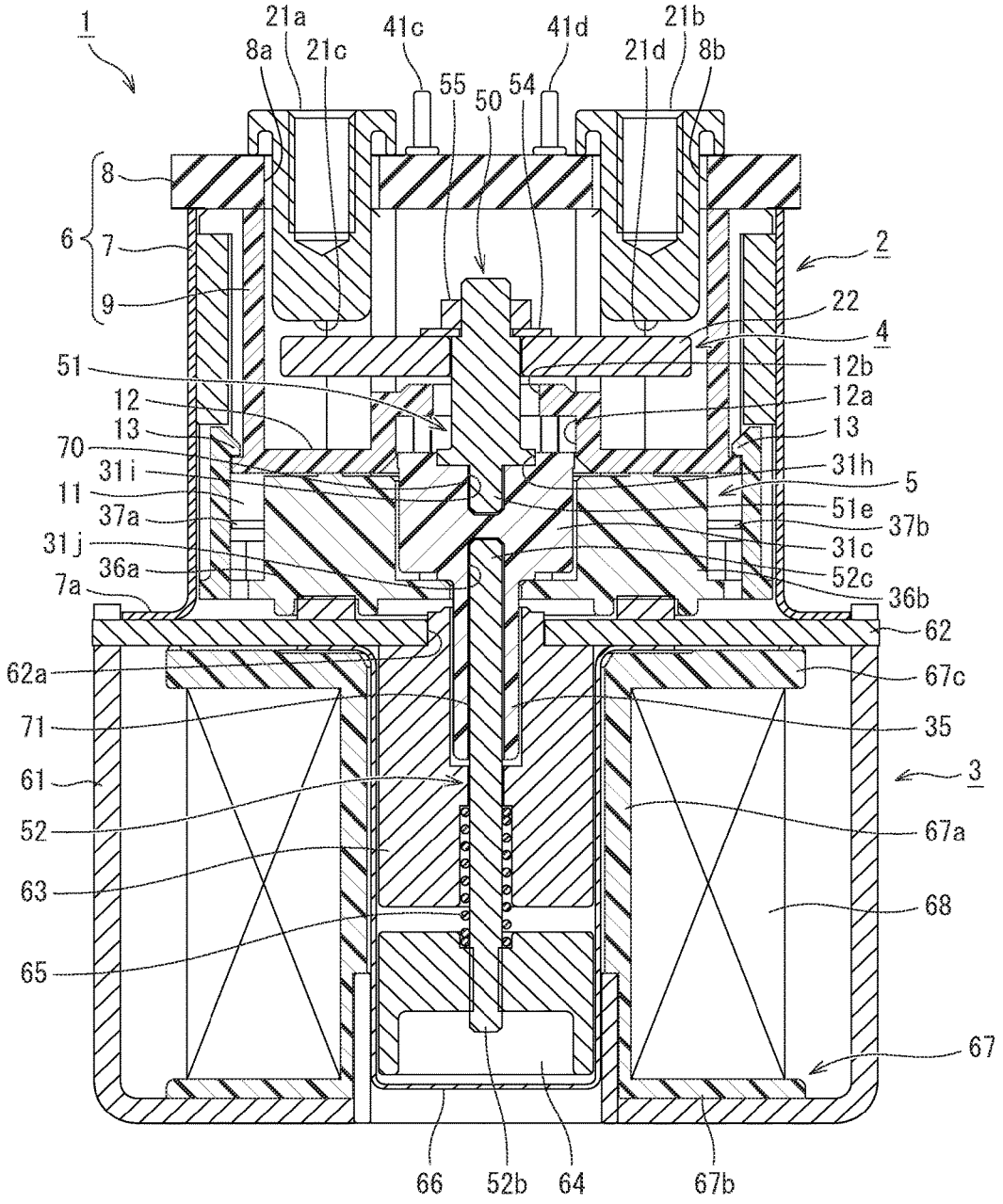
FIG. 7 illustrates a second embodiment of the electromagnetic contactor having the contact device according to the present invention, and is a sectional view similar to FIG. 3.
Figure 8:
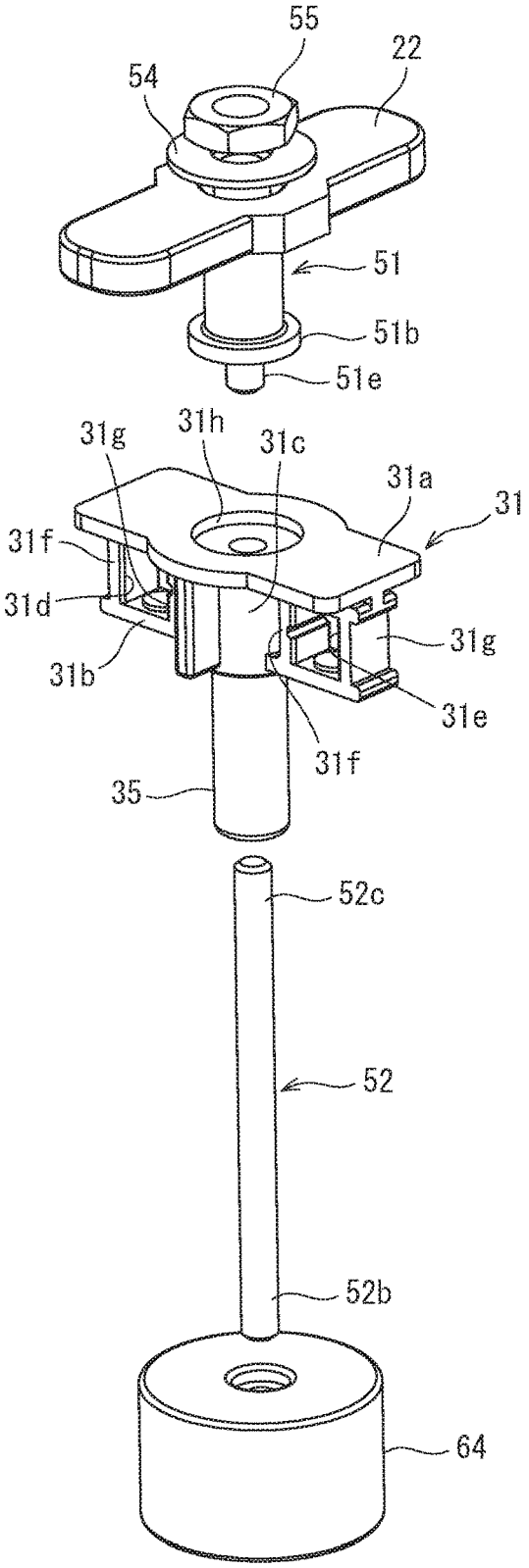
FIG. 8 is an exploded perspective view illustrating a movable shaft according to the second embodiment.

That is, according to the second embodiment, as illustrated in FIGS. 7 and 8, the flange 51*a* of the main contact support portion 51 configuring the movable shaft 50 according to the above-described first embodiment is omitted, and a small diameter protruding portion 51*e* is employed. The flange 52*a* formed in the support rod 52*c* of the auxiliary contact support portion 52 is omitted. In accordance with this configuration, a recess 31*h* for housing the spring seat 51*b* is formed in the plate 31*a* of the auxiliary contact holding member 31 of the auxiliary contact mechanism 5. A small diameter recess 31*i* communicating with the recess 31*h* is formed in the plate 31*a* and the columnar connection portion 31*c*. In addition, a fitting recess 31*j* which fits the support rod 52*c* of the auxiliary contact support portion 52 and which communicates with the cylindrical extending portion 35 is formed in the plate 31*b* and the columnar connection portion 31*c*.

After an adhesive 70 is applied to the periphery of the small diameter protruding portion 51*e* of the main contact support portion 51, the small diameter protruding portion 51*e* is fitted into the recess 31*i* of the auxiliary contact holding member 31, and the adhesive 70 is solidified. In this manner, an adhesive layer is formed between the small diameter protruding portion 51*e* and the recess 31*i*, thereby causing the main contact support portion 51 to be integrated with the auxiliary contact holding member 31.

Similarly, after an adhesive 71 is applied to the outer periphery of the support rod 52*c* of the auxiliary contact support portion 52 to be inserted into the cylindrical extending portion 35, an adhesive applied portion of the auxiliary contact support portion 52 is fitted into the cylindrical extending portion 35 and the recess 31*j* of the auxiliary contact holding member 31, and the adhesive 71 is solidified. In this manner, an adhesive layer is formed between the auxiliary contact support portion 52, the cylindrical extending portion 35, and the recess 31*j*, thereby causing the auxiliary contact support portion 52 to be integrated with the auxiliary contact holding member 31.

According to the second embodiment, the main contact support portion 51 and the auxiliary contact support portion 52 adhere to the auxiliary contact holding member 31 by using the adhesive, thereby configuring the movable shaft 50. Therefore, similarly to the above-described first embodiment, even in a case where the main contact support portion 51 and the auxiliary contact support portion 52 are formed of a conductive metal material, both of these can be insulated from each other by the auxiliary contact holding member 31 formed of an insulating material. Therefore, the charging unit which receives high voltage application can be housed inside the contact device 2. The electromagnetic unit 3 does not need a special insulating countermeasure such as a potting process using a resin, and the configuration can be simplified.

Moreover, the main contact support portion 51 and the auxiliary contact support portion 52 of the movable shaft 50 are joined to each other via the auxiliary contact holding member 31. Therefore, it is possible to obtain the same operation effect as that according to the above-described first embodiment in that a separate joining member is not required.

Third Embodiment

Next, a third embodiment according to the present invention will be described with reference to FIG. 9.

According to the third embodiment, the auxiliary contact holding member is joined to the main contact support portion and the auxiliary contact support portion by screwing.

Figure 9:
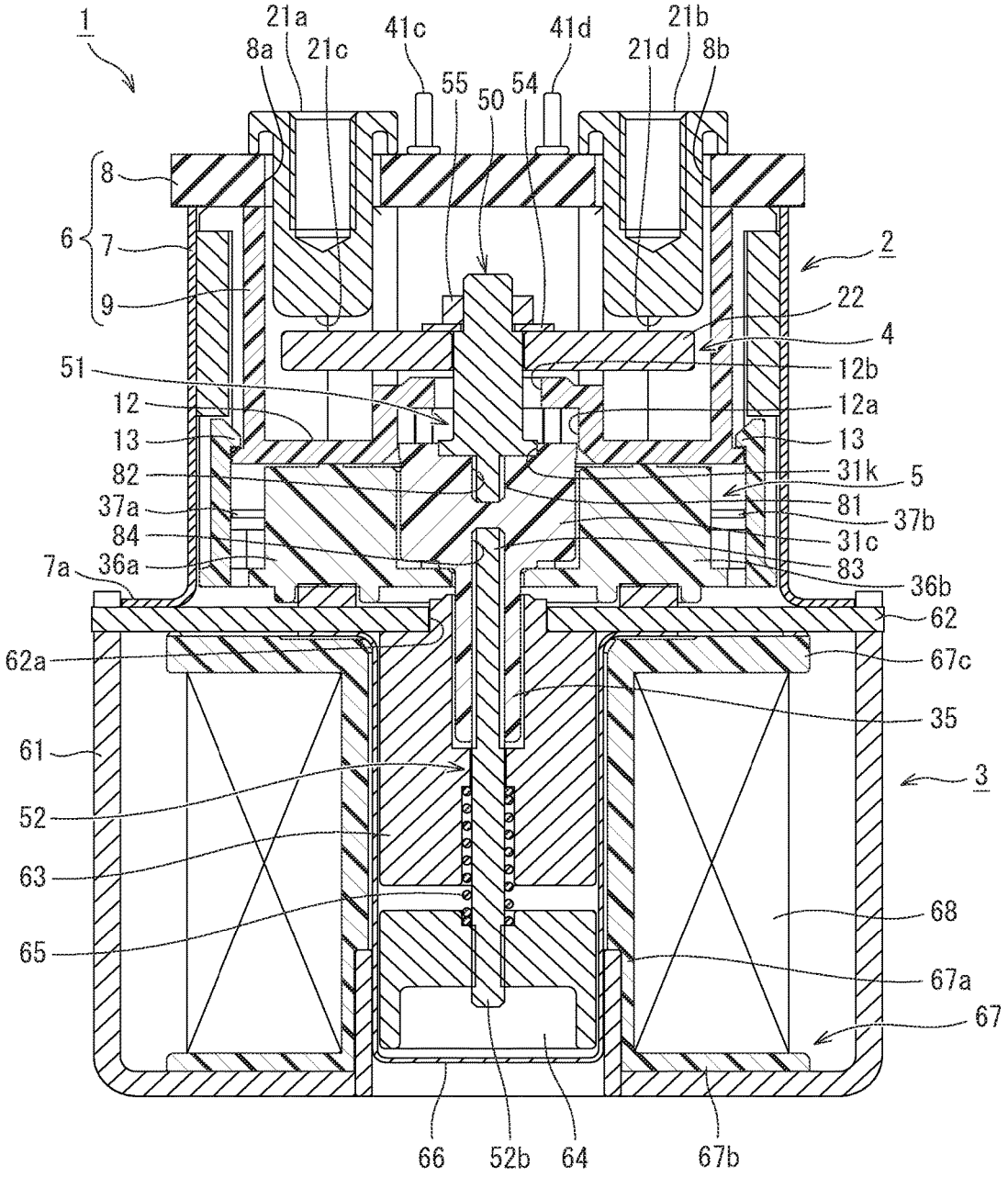
FIG. 9 illustrates a third embodiment of the electromagnetic contactor having the contact device according to the present invention, and is a sectional view similar to FIG. 3.

That is, according the third embodiment, as illustrated in FIG. 9, the small diameter protruding portion 51*e* of the main contact support portion 51 according to the above-described second embodiment is changed to a male screw 81, and the fitting recess 31*i* formed in the columnar connection portion 31*c* of the auxiliary contact holding member 31 is changed to a female screw 82. Similarly, the rod of the auxiliary contact support portion 52 and the portion inserted into the cylindrical extending portion 35 are changed to a male screw 83, and the recess 31*j* of the auxiliary contact holding member 31 and the inner peripheral surface of the cylindrical extending portion 35 are changed to a female screw 84.

In order to configure the movable shaft 50, the male screw 81 of the main contact support portion 51 is screwed and fastened to the female screw 82 of the auxiliary contact holding member 31, thereby integrating the auxiliary contact holding member 31 and the main contact support portion 51 with each other. Subsequently or beforehand, the male screw 83 of the auxiliary contact support portion 52 is screwed and fastened to the female screw 84 of the auxiliary contact holding member 31, thereby integrating the auxiliary contact holding member 31 and the auxiliary contact support portion 52 with each other. In this manner, the main contact support portion 51 and the auxiliary contact support portion 52 are joined to each other by the auxiliary contact holding member 31. Therefore, it is possible to configure the movable shaft 50.

According to the third embodiment, similarly to the above-described first and second embodiments, the main contact support portion 51 and the auxiliary contact support portion 52 in a state where both of these are insulated from each other can be joined to each other in the auxiliary contact holding member 31 formed of the insulating material. Therefore, the charging unit which receives high voltage application can be housed inside the contact device 2. The electromagnetic unit 3 does not need a special insulating countermeasure such as a potting process using a resin, and the configuration can be simplified and miniaturized. Therefore, it is possible to obtain the same operation effect as that according to the above-described first and second embodiments.

According to the third embodiment, the auxiliary contact holding member 31 and the auxiliary contact support portion 52 are joined to each other by screwing. Therefore, both of these can be firmly joined to each other. The length of the cylindrical extending portion 35 of the auxiliary contact holding member 31 can be shortened or omitted.

Fourth Embodiment

Next, a fourth embodiment according to the present invention will be described with reference to FIG. 10.

According to the fourth embodiment, the main contact support portion and the auxiliary contact support portion are integrated with each other by both of these being formed of an insulating member.

Figure 10:
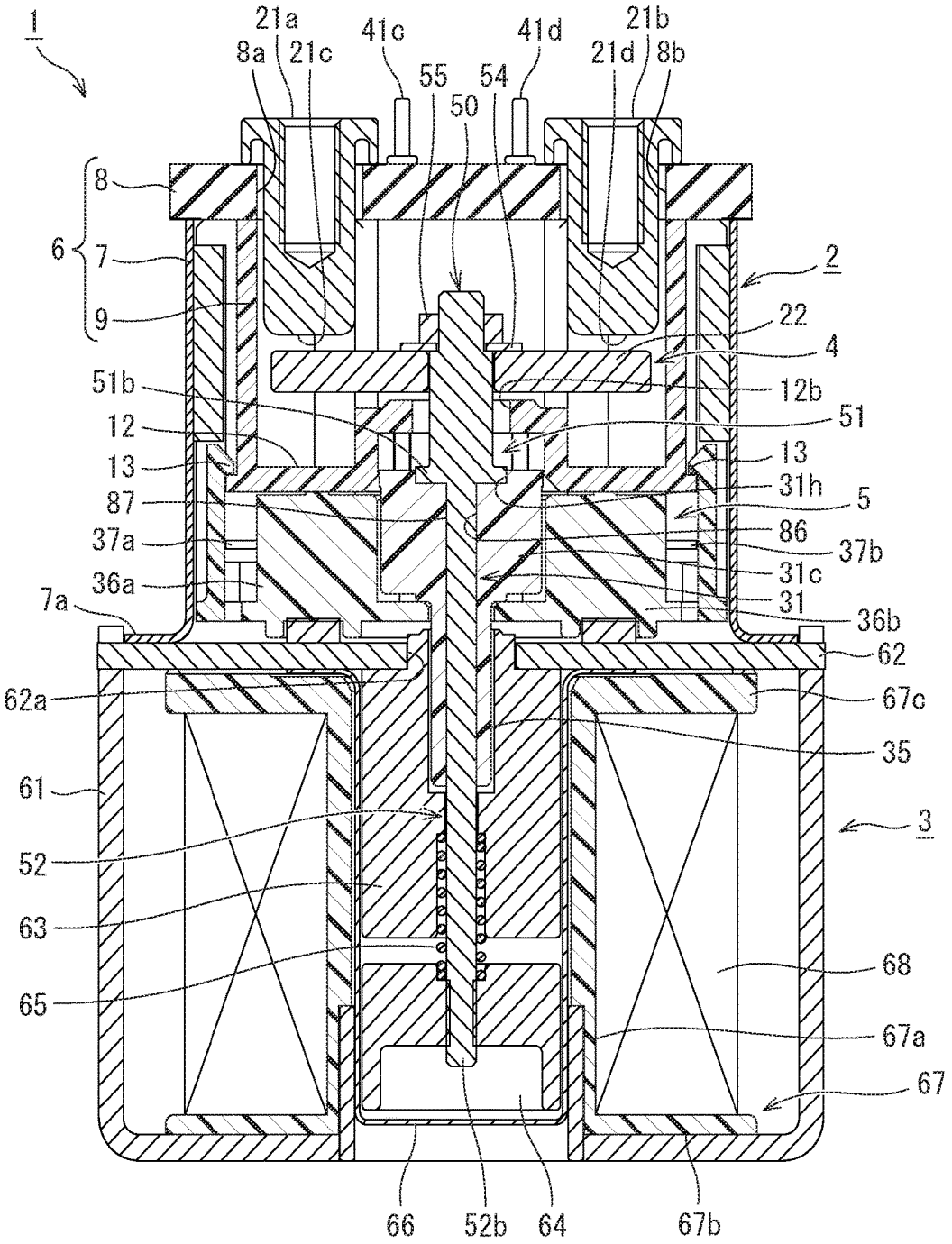
FIG. 10 illustrates a fourth embodiment of the electromagnetic contactor having the contact device according to the present invention, and is a sectional view similar to FIG. 3.

That is, according to the fourth embodiment, as illustrated in FIG. 10, for example, the main contact support portion 51 and the auxiliary contact support portion 52 are integrated with each other by performing injection molding on an insulating member such as a hard synthetic resin, thereby configuring the movable shaft 50. In accordance with this configuration, the columnar connection portion 31*c* of the auxiliary contact holding member 31 is changed to a cylindrical portion 86 connected to the cylindrical extending portion 35. After an adhesive 87 is applied to an outer peripheral surface of an insertion portion to be inserted into the auxiliary contact holding member 31 in the movable shaft 50, the movable shaft 50 is caused to pass through the cylindrical portion 86 from the auxiliary contact support portion 52 side. The male screw 52*b* is caused to protrude from the cylindrical extending portion 35 through the cylindrical extending portion 35. The spring seat 51*b* is caused to engage with the recess 31*h* formed on the upper surface of the auxiliary contact holding member 31. In this state, the adhesive 87 is solidified, thereby forming an adhesive layer between the auxiliary contact holding member 31 and the movable shaft 50. In this manner, both of these are integrated with each other.

According to the fourth embodiment, the movable shaft 50 itself is formed of the insulating material. Accordingly, the movable shaft 50 for supporting the main movable contact 22 does not serve as the charging unit which receives high voltage application. The charging unit can be housed inside the main contact mechanism 4, and thus, a region for charging countermeasure can be further reduced. Therefore, it is possible to further miniaturize the configuration of the contact device 2 and the electromagnetic contactor 1 using the same, and it is possible to reduce the weight.

In the above-described fourth embodiment, a case has been described where the movable shaft 50 is configured as the injection-molded product. However, without being limited thereto, a rod-shaped body may be cut so as to form the movable shaft 50.

Fifth Embodiment

Next, a fifth embodiment according to the present invention will be described with reference to FIG. 11.

According to the fifth embodiment, the movable shaft and the auxiliary contact holding member are integrated with each other by means of resin molding.

Figure 11:
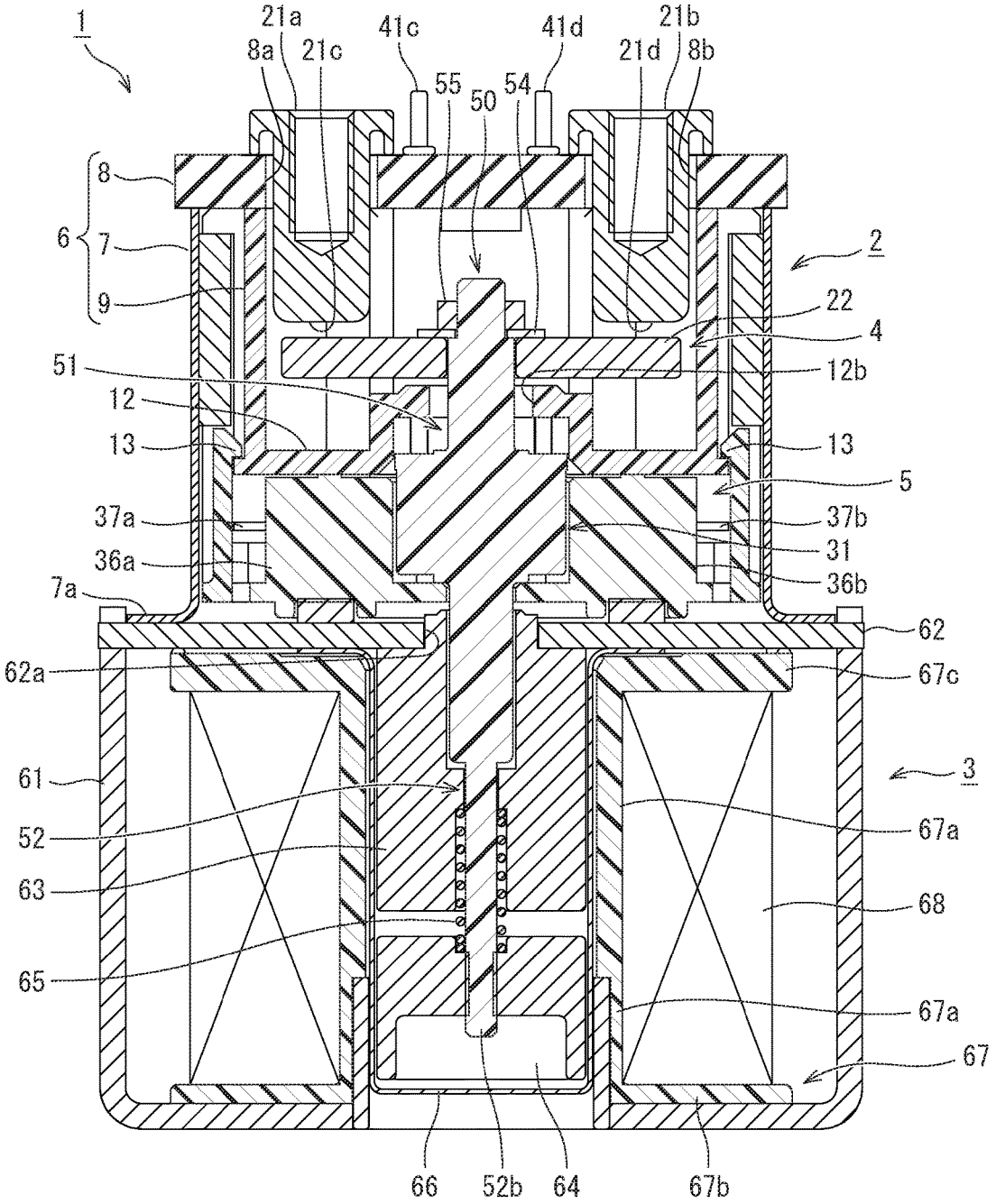
FIG. 11 illustrates a fifth embodiment of the electromagnetic contactor having the contact device according to the present invention, and is a sectional view similar to FIG. 3.

That is, according to the fifth embodiment, as illustrated in FIG. 11, for example, a hard resin material is used for injection molding. In this manner, the main contact support portion 51 and the auxiliary contact support portion 52 configuring the movable shaft 50, and the auxiliary contact holding member 31 are integrated with each other, thereby configuring an integrally molded product.

According to the fifth embodiment, the auxiliary contact holding member 31, the main contact support portion 51, and the auxiliary contact support portion 52 are integrated with each other by using an insulating member. Accordingly, it is possible to obtain the same operation effect as that according to the above-described fourth embodiment. In addition, it is no longer necessary to perform a process of joining the movable shaft 50 and the auxiliary contact holding member 31 to each other. As a result, it is possible to reduce assembling processes of the contact device 2 and the electromagnetic contactor 1 using the same, and it is possible to reduce the number of components.

Sixth Embodiment

Next, a sixth embodiment according to the present invention will be described with reference to FIGS. 12 and 13.

According to the sixth embodiment, the auxiliary contact support portion and the auxiliary contact holding member are integrated with each other, and the auxiliary contact holding member and the main contact support portion are screwed to each other. In this manner, it is possible to adjust a wipe amount of the pressure spring which applies the contact pressure to the main movable contact 22.

Figure 12:
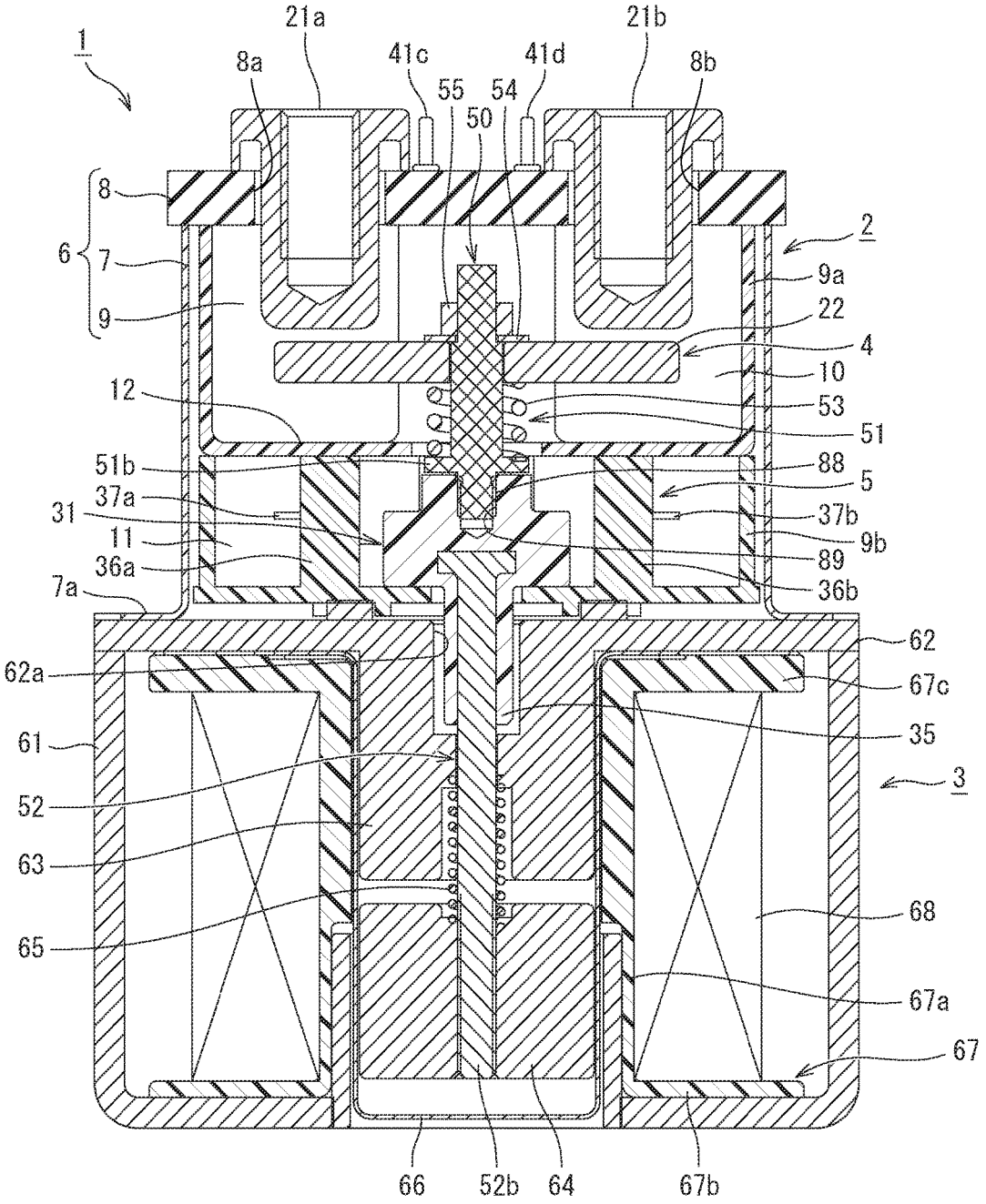
FIG. 12 illustrates a sixth embodiment of the electromagnetic contactor having the contact device according to the present invention, and is a sectional view similar to FIG. 3.
Figure 13:
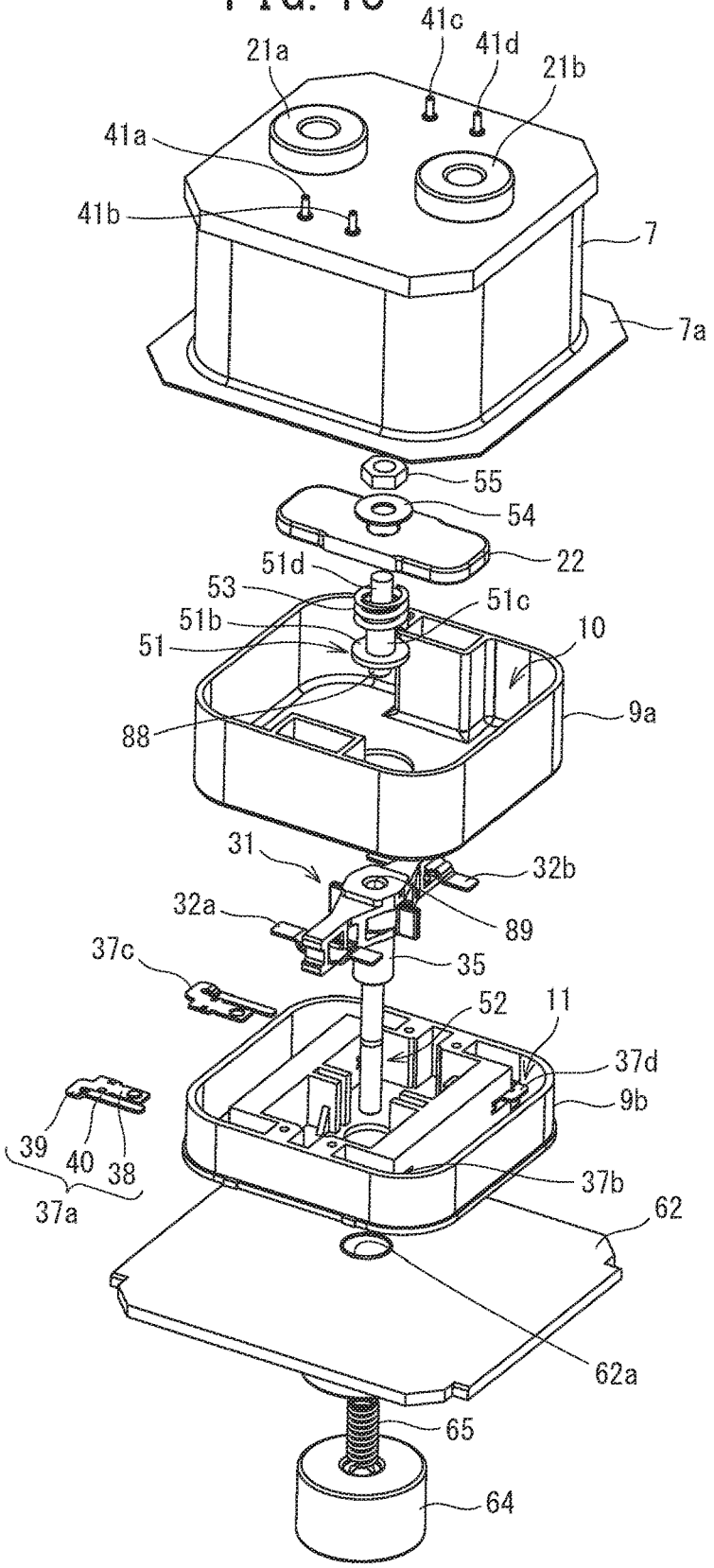
FIG. 13 is an exploded perspective view of the contact device in FIG. 12.

That is, according to the sixth embodiment, as illustrated in FIGS. 12 and 13, similarly to the above-described first embodiment, the auxiliary contact holding member 31 and the auxiliary contact support portion 52 configuring the movable shaft 50 are integrated with each other by performing insert molding of the auxiliary contact support portion 52 on the auxiliary contact holding member 31.

On the other hand, in the main contact support portion 51 configuring the movable shaft 50, the flange 51*a* according to the first embodiment is omitted. Alternatively, a male screw 88 which protrudes downward from the spring seat 51*b* is formed therein.

Furthermore, a female screw 89 to which the male screw 88 of the main contact support portion 51 is screwed is formed in the plate 31*a* and the columnar connection portion 31*c* of the auxiliary contact holding member 31.

The male screw 88 of the main contact support portion 51 is screwed to the female screw 89 of the auxiliary contact holding member 31. In this manner, the auxiliary contact holding member 31 and the main contact support portion 51 are integrated with each other, thereby forming the movable shaft 50. Furthermore, the inner polygonal tubular body 9 is configured to include a bottomed polygonal tubular portion 9*a* forming the main contact housing portion 10 and a bottomed polygonal tubular portion 9*b* forming the auxiliary contact housing portion 11.

According to the sixth embodiment, the main contact support portion 51 and the auxiliary contact support portion 52 are joined via the auxiliary contact holding member 31 formed of the insulating material. Therefore, similarly to the above-described first embodiment, even in a case where the main contact support portion 51 and the auxiliary contact support portion 52 are formed of a conductive metal material, both of these can be insulated from each other by the auxiliary contact holding member 31 formed of the insulating material. Therefore, the charging unit which receives high voltage application can be housed inside the contact device 2. The electromagnetic unit 3 does not need a special insulating countermeasure such as a potting process using a resin, and the configuration can be simplified.

In addition, the male screw 88 of the main contact support portion 51 is screwed to the female screw 89 of the auxiliary contact holding member 31. Accordingly, a wipe amount of the main movable contact 22 of the main contact mechanism 4 can be adjusted by adjusting a screwing depth of the male screw 88. Here, the wipe amount represents a movement amount of the movable shaft 50 until the main movable contact 22 is in a completely "closed state" from when the main movable contact 22 starts to come into contact with the pair of main fixed contacts 21*a* and 21*b*.

In the electromagnetic contactor 1, in a case where a stroke of the movable shaft 50 is as short as approximately 2 mm, the wipe amount of the main movable contact 22 is approximately 1 mm. As in the above-described first to third embodiments and the fifth embodiment, in a case where the main contact support portion 51 configuring the movable shaft 50 is fixed to the auxiliary contact holding member 31, it is not possible to adjust the wipe amount of the main movable contact 22, and it is difficult to very accurately set the wipe amount of approximately 1 mm.

In contrast, according to the sixth embodiment, the main contact support portion 51 configuring the movable shaft 50 is joined to the auxiliary contact holding member 31 by screwing. Accordingly, the wipe amount of the main movable contact 22 can be adjusted by adjusting the screwing depth for screwing the male screw 88 of the main contact support portion 51 to the female screw 89 of the auxiliary contact holding member 31.

If the wipe amount is completely adjusted, an adhesive is injected and solidified between the lower surface of the spring seat 51*b* and the upper surface of the auxiliary contact holding member 31, or an anti-rotation member is inserted so as to stop the rotation.

When the wipe amount is adjusted, the main contact support portion 51 is rotated. In a case where a facing position relationship between the main movable contact 22 and the pair of main fixed contacts 21*a* and 21*b* is deviated due to the rotation of the main contact support portion 51, the nut 55 is unfastened, and the main movable contact 22 is caused to return to the original position. Thereafter, the nut 55 is fastened again.

In this way, according to the sixth embodiment, similarly to the above-described first to fifth embodiments, the main contact support portion 51 and the auxiliary contact support portion 52 are joined to each other via the auxiliary contact holding member 31 formed of the insulating material. Therefore, the charging unit which receives high voltage application can be housed inside the contact device 2. The electromagnetic unit 3 does not need a special insulating countermeasure such as a potting process using a resin, and the configuration can be simplified. In this regard, it is possible to obtain the same operation effect as that according to the above-described first and second embodiments.

In addition, the main contact support portion 51 is mounted on the auxiliary contact holding member 31 so that the wipe amount of the main movable contact 22 is adjustable. Therefore, it is possible to easily and very accurately adjust the wipe amount of the main movable contact 22.

Seventh Embodiment

Figure 14:
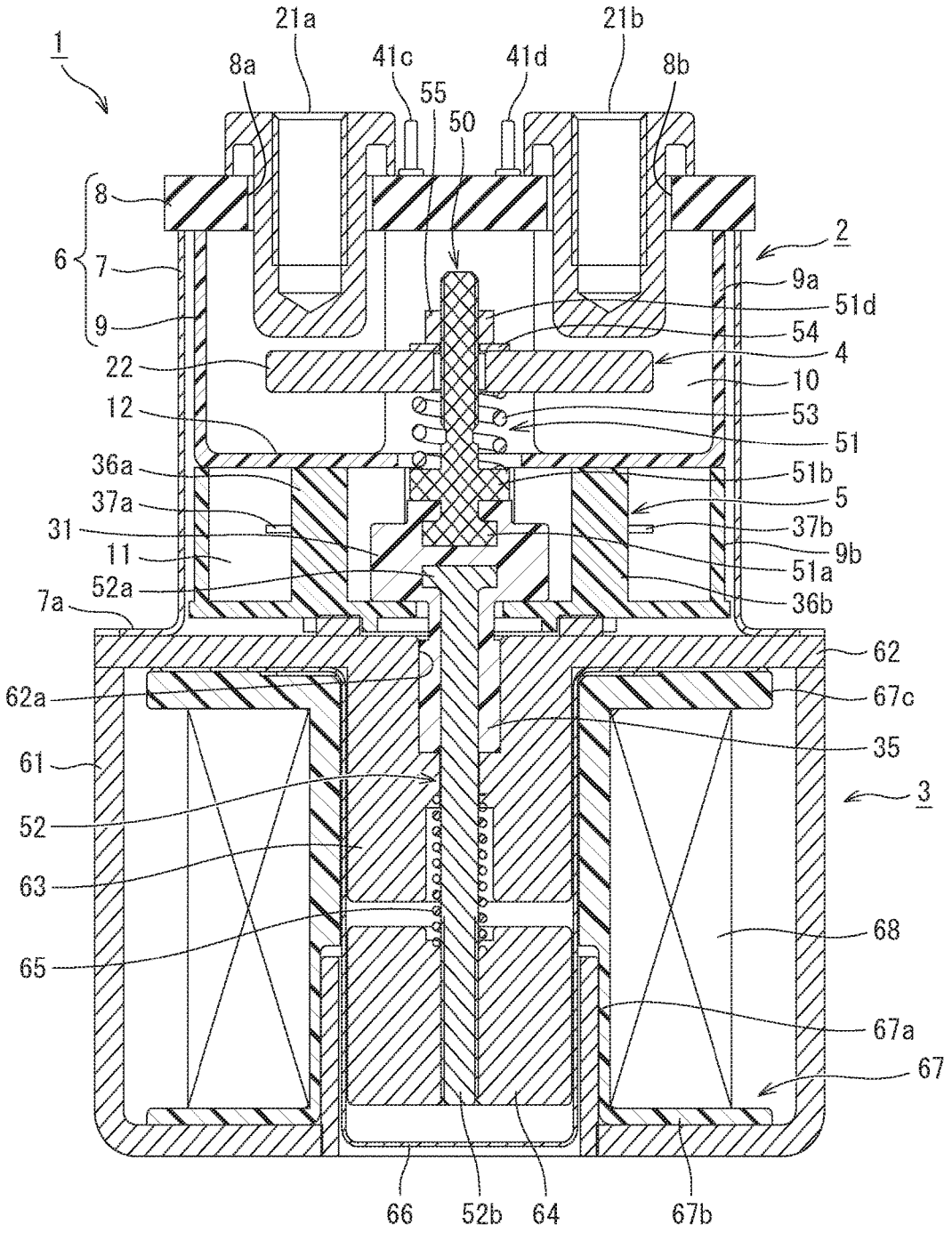
FIG. 14 illustrates a seventh embodiment of the electromagnetic contactor having the contact device according to the present invention, and is a sectional view similar to FIG. 3.

Next, a seventh embodiment of the electromagnetic contactor including the contact device according to the present invention will be described with reference to FIG. 14.

According to the seventh embodiment, the wipe amount of the main movable contact can be adjusted by the main contact support portion.

That is, according to the seventh embodiment, the support rod 51*c* of the main contact support portion 51 configuring the movable shaft 50 according to the above-described first embodiment is omitted. Alternatively, except that the male screw 51*d* extends close to the spring seat 51*b*, the seventh embodiment has the same configuration as the configuration according to the above-described first embodiment.

According to the seventh embodiment, the main contact support portion 51 and the auxiliary contact support portion 52 are integrated with the auxiliary contact holding member 31 by means of insert molding, thereby forming the movable shaft 50. Accordingly, similarly to the above-described first embodiment, the charging unit which receives high voltage application can be housed inside the contact device 2. Therefore, it is possible to obtain the same operation effect as that according to the first embodiment.

In addition, according to the seventh embodiment, in addition to the above-described effect, the male screw 51*d* of the main contact support portion 51 extends close to the spring seat 51*b*. Accordingly, the wipe amount of the main movable contact 22 can be adjusted by adjusting the screwing amount of the nut 55.

That is, the male screw 51*d* of the main contact support portion 51 is inserted into the pressure spring 53. Subsequently, after being inserted into the through-hole 22*a* of the main movable contact 22, the washer 54 and the nut 55 are mounted on the male screw 51*d*.

In this state, the nut 55 is screwed, thereby moving the main movable contact 22 to the spring seat 51*b* side against the pressure spring 53. In this manner, it is possible to adjust the wipe amount indicating a stroke of the movable shaft 50 until the main movable contact 22 is completely brought into a closed state from when the main movable contact 22 starts to come into contact with the pair of main fixed contacts 21*a* and 21*b*.

When the wipe amount is completely adjusted, the main contact support portion 51 and the nut 55 are fixed to each other by using the adhesive or by means of welding, thereby preventing a change in the wipe amount.

According to the seventh embodiment, similarly to the first embodiment, the main contact support portion 51 and the auxiliary contact support portion 52 configuring the movable shaft 50 are also joined to each other by the auxiliary contact holding member 31 formed of the insulating material. Accordingly, the charging unit which receives high voltage application can be housed inside the contact device 2. Therefore, it is possible to simplify the insulating countermeasure of the electromagnetic unit 3, and it is possible to miniaturize the electromagnetic unit 3.

In addition, the main movable contact 22 can be moved in the axial direction by screwing the nut 55 screwed to the male screw 51*d* of the main contact support portion 51. Therefore, it is possible to obtain an advantageous effect in that the wipe amount of the main movable contact 22 can be freely and very accurately adjusted.

Eighth Embodiment

Next, an eighth embodiment of the electromagnetic contactor including the contact device according to the present invention will be described with reference to FIGS. 15 to 18.

According to the eighth embodiment, the wipe amount of the main movable contact is adjusted without changing a compression amount of the pressure spring of the main movable contact.

Figure 17:
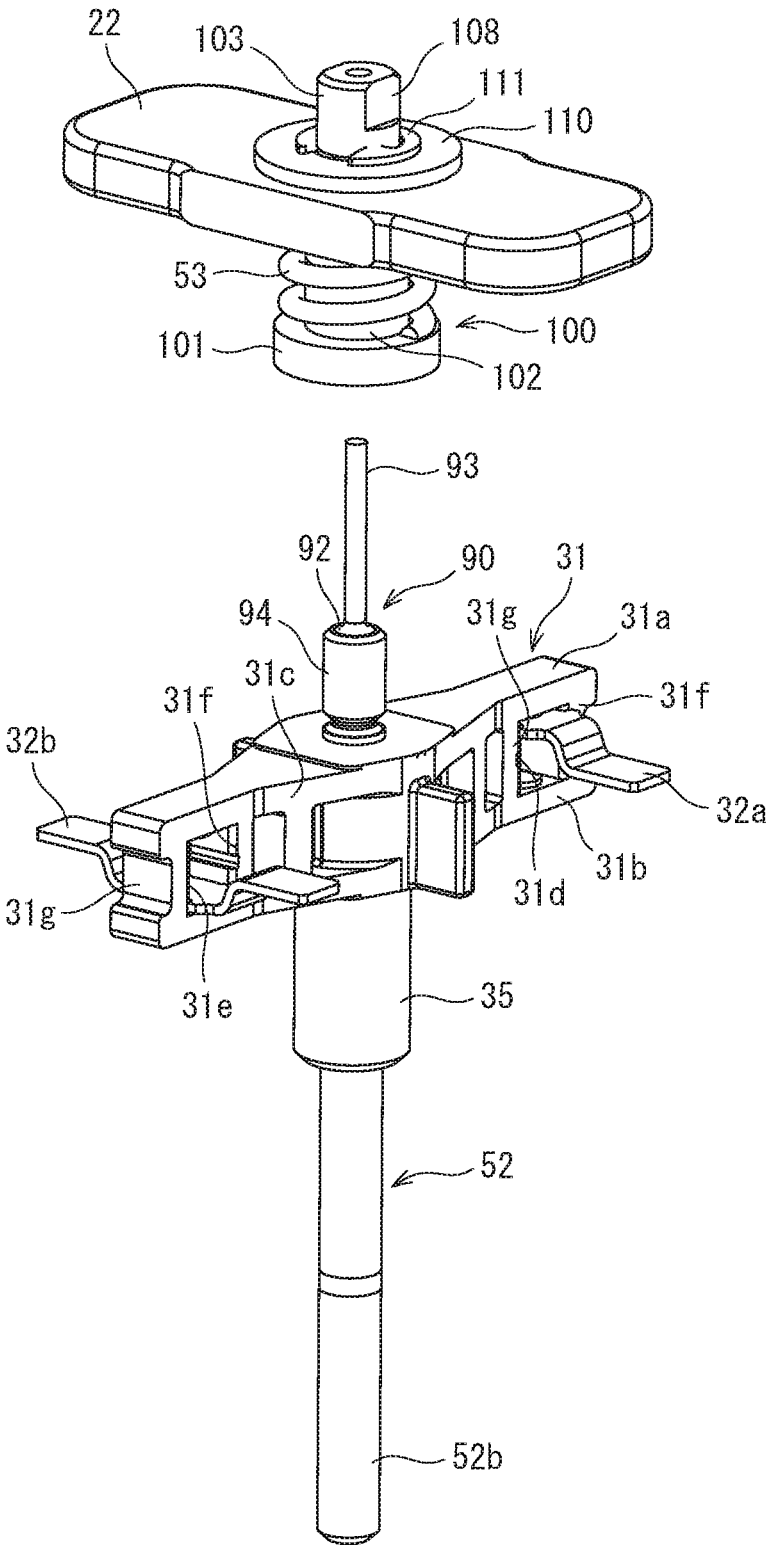
FIG. 17 is an exploded perspective view illustrating a movable shaft according to the eighth embodiment.
Figure 18:
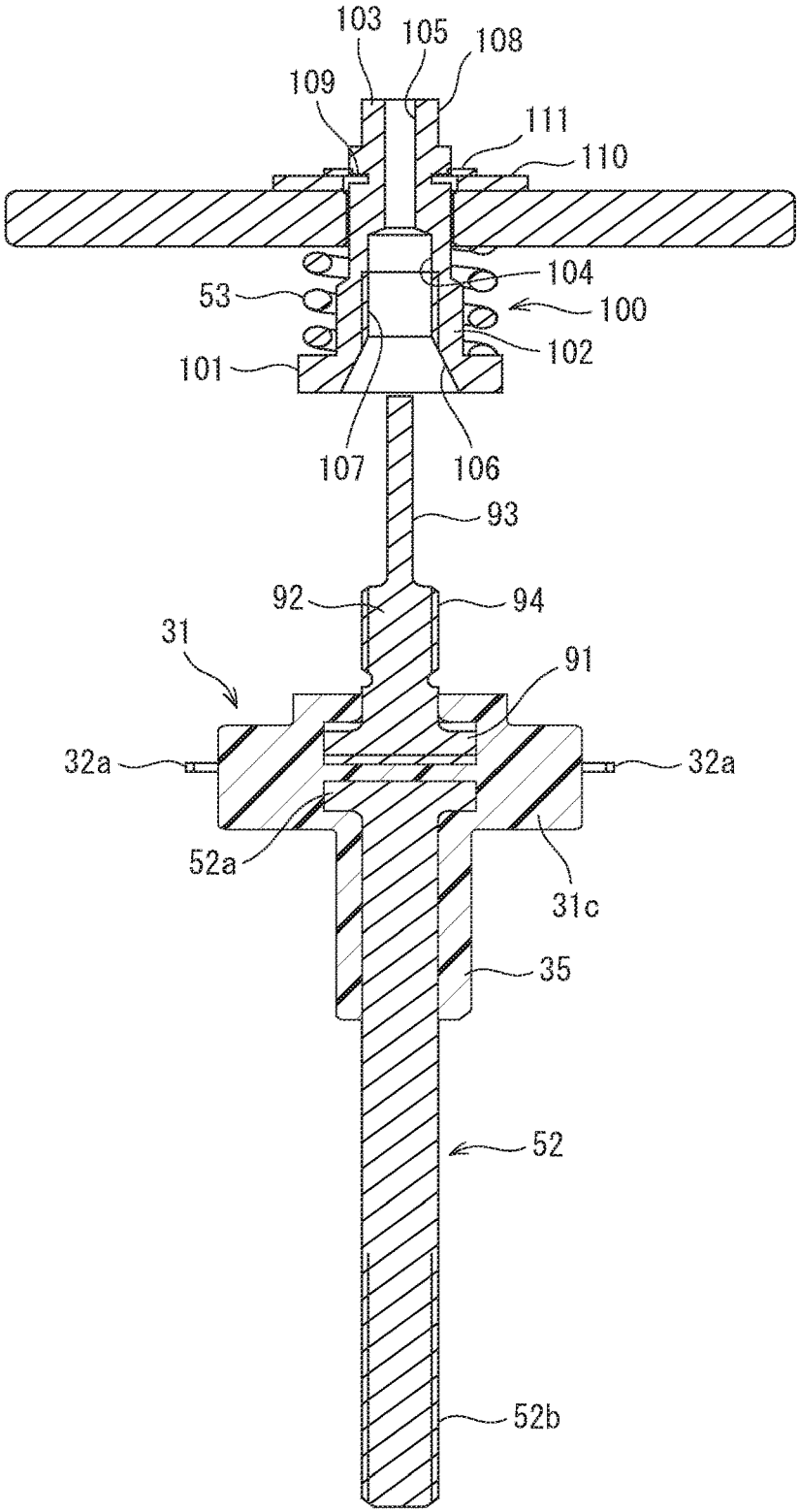
FIG. 18 is a sectional view illustrating an exploded state of the movable shaft according to the eighth embodiment.

That is, according to the eighth embodiment, as illustrated in FIGS. 17 and 18, the main contact support portion 51 configuring the movable shaft 50 is configured to include a support shaft 90 and a main movable contact support 100 joined to the support shaft 90 so as to be movable in the axial direction.

The support shaft 90 includes a large diameter shaft 92 whose lower end has a flange 91, and a small diameter shaft 93 connected to a side of the large diameter shaft 92 which is opposite to the flange 91. The small diameter shaft 93 has a male screw 94 on the small diameter shaft 93 side. The flange 91 is buried in the auxiliary contact holding member 31 by means of insert molding, similarly to the above-described first embodiment, so as to integrate the support shaft 90 with the auxiliary contact holding member 31.

The main movable contact support 100 includes a large diameter cylindrical portion 102 whose lower end outer peripheral surface has a large diameter spring seat 101 protruding in the radial direction, and a small diameter cylindrical portion 103 connected to a side of the large diameter cylindrical portion 102 which is opposite to the spring seat 101.

An inner peripheral surface of the large diameter cylindrical portion 102 has a large diameter hole 104 leading to the small diameter cylindrical portion 103 from an end surface on the spring seat 101 side, and has a small diameter hole 105 connected to a side of the large diameter hole 104 which is opposite to the spring seat 101.

An inner surface of the large diameter hole 104 which corresponds to the spring seat 101 has a conical inner surface 106 whose diameter decreases upward from the end surface. In addition, a female screw 107 screwed to the male screw 94 of the support shaft 90 is formed between a connection portion of the large diameter hole 104 and the conical inner surface 106 and a connection portion of the large diameter cylindrical portion 102 and the small diameter cylindrical portion 103.

Furthermore, a width across flat 108 is formed on an end portion outer peripheral surface on a side of the small diameter cylindrical portion 103 which is opposite to the large diameter cylindrical portion 102. A circumferential groove 109 is formed on the large diameter cylindrical portion 102 side relative to the width across flat 108.

In the main movable contact support 100, the main movable contact 22 is supported as follows. That is, as illustrated in FIGS. 17 and 18, the main movable contact support 100 is inserted into the inner peripheral surface of the pressure spring 53 from the width across flat 108 side of the main movable contact support 100. The pressure spring 53 is mounted on the outer peripheral surface of the large diameter cylindrical portion 102, and is brought into contact with the spring seat 101. In this state, the small diameter cylindrical portion 103 is inserted into the through-hole 22*a* of the main movable contact 22 from the width across flat 108 side. In a state where the pressure spring 53 is pressed until the circumferential groove 109 is exposed from the upper surface side of the main movable contact 22, a washer 110 is mounted on the small diameter cylindrical portion 103, and an E-ring (retaining ring) 111 serving as a fixing portion is mounted on the circumferential groove 109. In this state, the pressure spring 53 pressed by the main movable contact 22 is released. In this manner, the main movable contact 22 comes into contact with the E-ring 111 via the washer 110 at predetermined contact pressure and is supported so as to be movable in the axial direction.

The main movable contact support 100 is screwed to the support shaft 90, thereby configuring the movable shaft 50. That is, in a state where the main movable contact support 100 is not mounted on the main contact support portion 51 of the movable shaft 50, the small diameter shaft 93 of the support shaft 90 is inserted into the small diameter hole 105 through the conical inner surface 106 and the large diameter hole 104 of the large diameter cylindrical portion 102 of the main movable contact support 100. The male screw 94 formed in the large diameter shaft 92 is screwed to the female screw 107 of the main movable contact support 100. In this manner, it is possible to configure the movable shaft 50.

Figure 15:
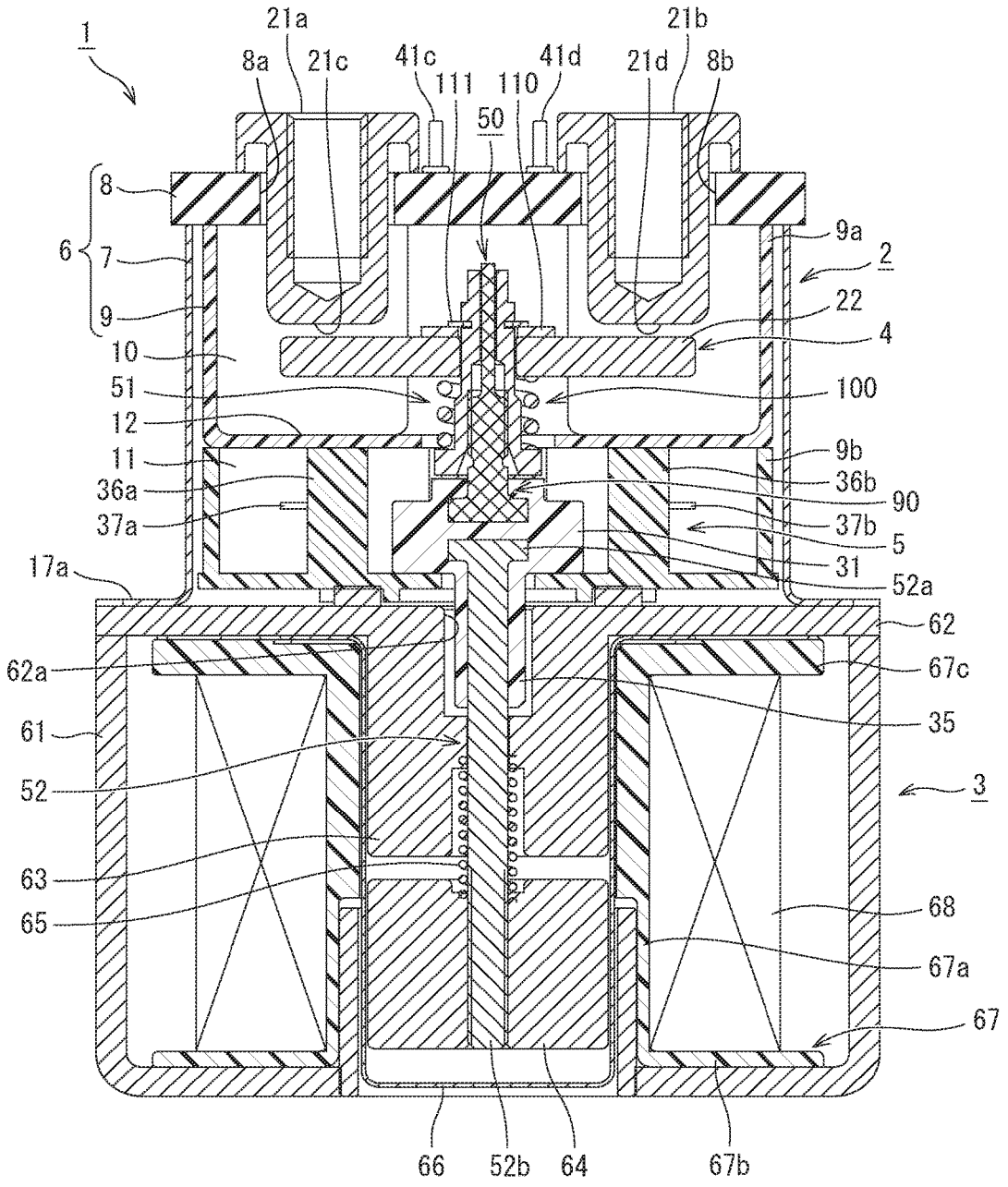
FIG. 15 illustrates an eighth embodiment of the electromagnetic contactor having the contact device according to the present invention, and is a sectional view similar to FIG. 3.
Figure 16:
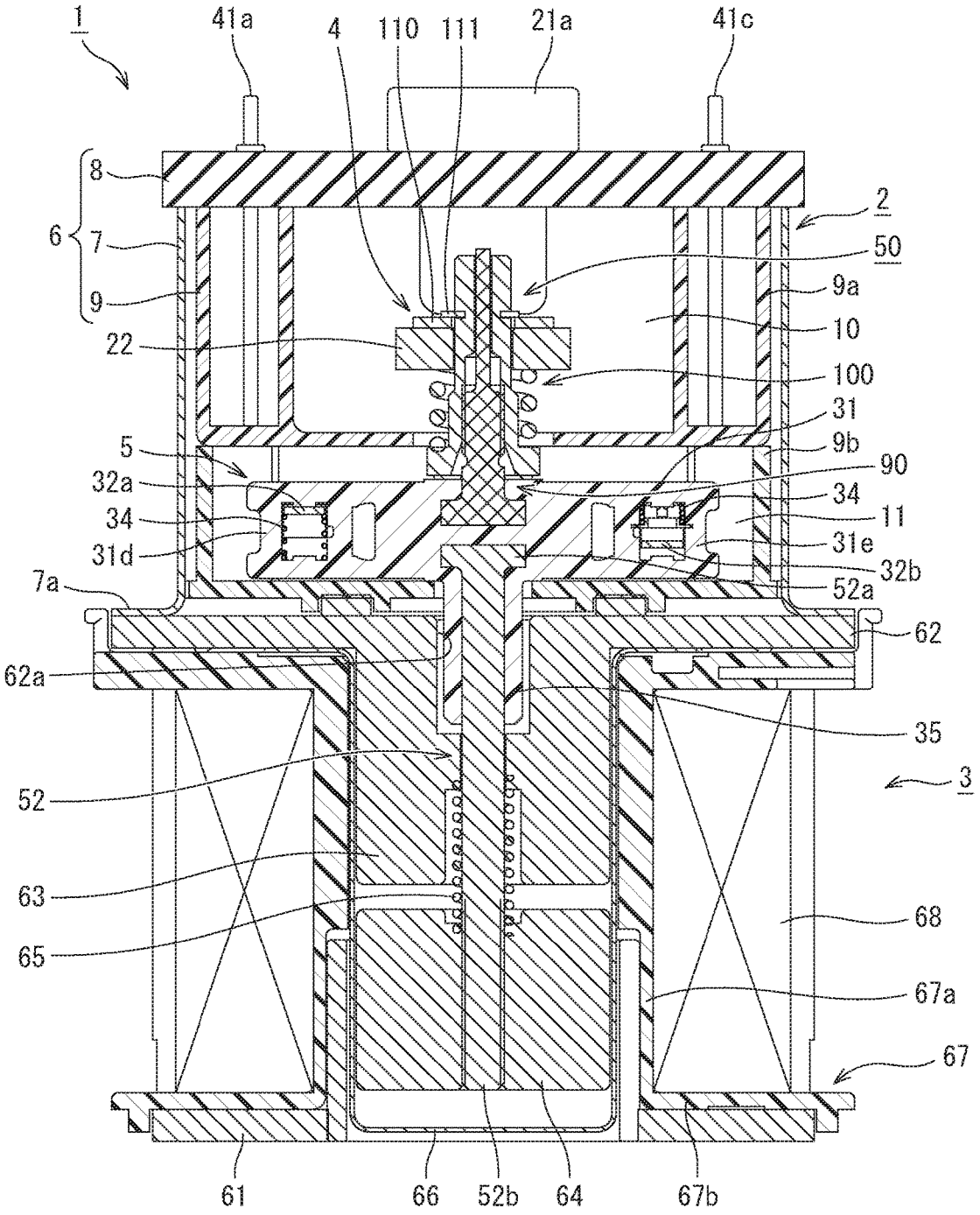
FIG. 16 illustrates the eighth embodiment, and is a sectional view similar to FIG. 4.

In order to mount the movable shaft 50 on the electromagnetic contactor 1, as illustrated in FIGS. 15 and 16, the auxiliary contact housing portion 11 is first disposed on the upper surface of the upper magnetic yoke 62. In this state, before the main movable contact 22 is mounted on the main movable contact support 100, the auxiliary contact support portion 52 is caused to protrude downward through a central hole of the fixed iron core 63 fixed to the upper magnetic yoke 62. In this state, the auxiliary contact holding member 31 is disposed between the fixed contact holders 36*a* and 36*b* formed in the auxiliary contact housing portion 11.

In a state where the main contact housing portion 10 is disposed on the auxiliary contact housing portion 11, the pressure spring 53 and the main movable contact 22 are mounted on the main movable contact support 100 of the main contact support portion 51 as described above, and the upper end position in the axial direction is fixed by the E-ring 111. Subsequently, a tool is mounted on the width across flat 108, and the main movable contact support 100 is rotated, thereby adjusting the screwing depth of the male screw 94 of the support shaft 90, which is screwed to the female screw 107 of the main movable contact support 100. In this manner, the wipe amount of the main movable contact 22 is adjusted. If the wipe amount is completely adjusted, the support shaft 90 and the main movable contact support 100 are fixed to each other by fixing means such as brazing and bonding.

Thereafter, the movable iron core 64 is rotated and the axial position of the auxiliary contact support portion 52 is adjusted, thereby adjusting a gap amount between the pair of main fixed contacts 21*a* and 21*b* and the main movable contact 22. If the gap amount is completely adjusted, the movable iron core 64 and the auxiliary contact support portion 52 are fixed to each other by fixing means such as brazing and bonding.

Thereafter, the fixed iron core 63 and the movable iron core 64 of the electromagnetic unit 3 are covered with the cap 66, and the cap 66 is joined to the upper magnetic yoke 62 in an airtight state. After the spool 67 is mounted on the outer periphery of the cap 66, the magnetic yoke 61 is fixed to the upper magnetic yoke 62, thereby completely assembling the electromagnetic unit 3.

Simultaneously or beforehand, the contact housing portion 6 on which the main fixed contacts 21*a* and 21*b* of the contact device 2 are mounted is mounted. The flange 7*a* of the outer polygonal tubular body 7 is joined to the upper surface of the upper magnetic yoke 62 in an airtight state. In this manner, the contact device 2 is completely assembled.

In this way, the contact device 2 and the electromagnetic unit 3 are completely assembled, thereby completely assembling the electromagnetic contactor 1.

According to the eighth embodiment, similarly to the first embodiment, the main contact support portion 51 and the auxiliary contact support portion 52 configuring the movable shaft 50 are joined to each other by the auxiliary contact holding member 31 formed of the insulating material. Accordingly, the charging unit which receives high voltage application can be housed inside the contact device 2.

Therefore, it is possible to simplify the insulating countermeasure of the electromagnetic unit 3, and it is possible to miniaturize the electromagnetic unit 3.

In addition, the main contact support portion 51 is configured to include the support shaft 90 and the main movable contact support 100. The support shaft 90 and the main movable contact support 100 are joined to each other using the male screw 94 and the female screw 107. Accordingly, similarly to the above-described seventh embodiment, it is possible to obtain the advantageous effect in that the wipe amount of the main movable contact 22 can be very accurately adjusted by rotating the main movable contact support 100.

Moreover, the pressure spring 53 and the main movable contact 22 are mounted on the main movable contact support 100. Accordingly, the wipe amount of the main movable contact 22 can be adjusted without changing the compression amount of the pressure spring 53.

Figure 19:
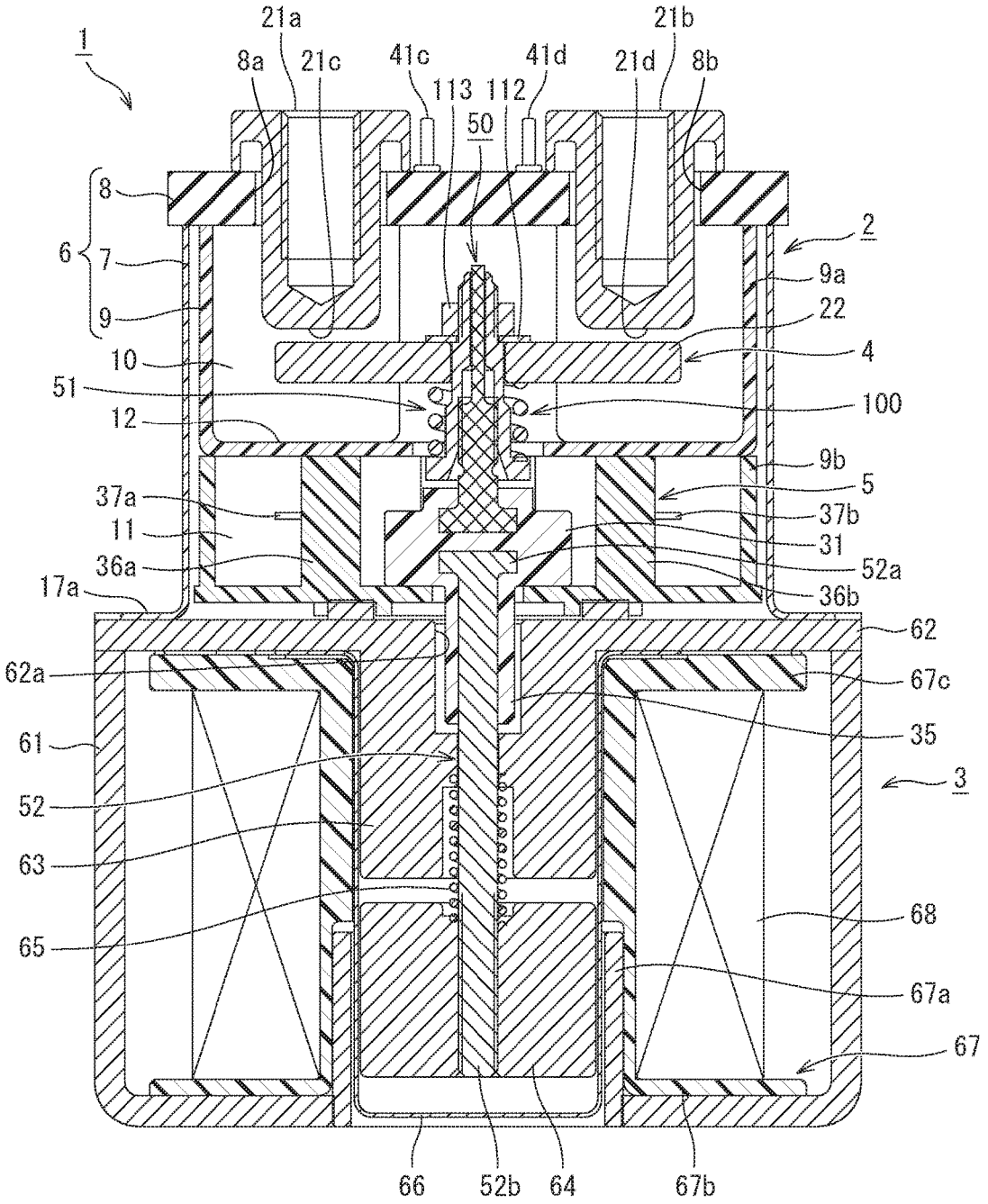
FIG. 19 illustrates a modification example of the eighth embodiment, and is a sectional view similar to FIG. 3.

In the above-described eighth embodiment, a case has been described where the upper end position of the main movable contact 22 is fixed to the main movable contact support 100 by using the E-ring 111. However, without being limited thereto, as illustrated in FIG. 19, the upper end position of the main movable contact 22 may be fixed by using a washer 112 and a nut 113.

Ninth Embodiment

Next, a ninth embodiment of the electromagnetic contactor including the contact device according to the present invention will be described with reference to FIGS. 20 and 21.

According to the ninth embodiment, in a state where the support shaft and the main movable contact support which configure the main contact support portion are integrated with each other, the wipe amount of the main movable contact is adjusted by using an adjusting piece.

Figure 20:
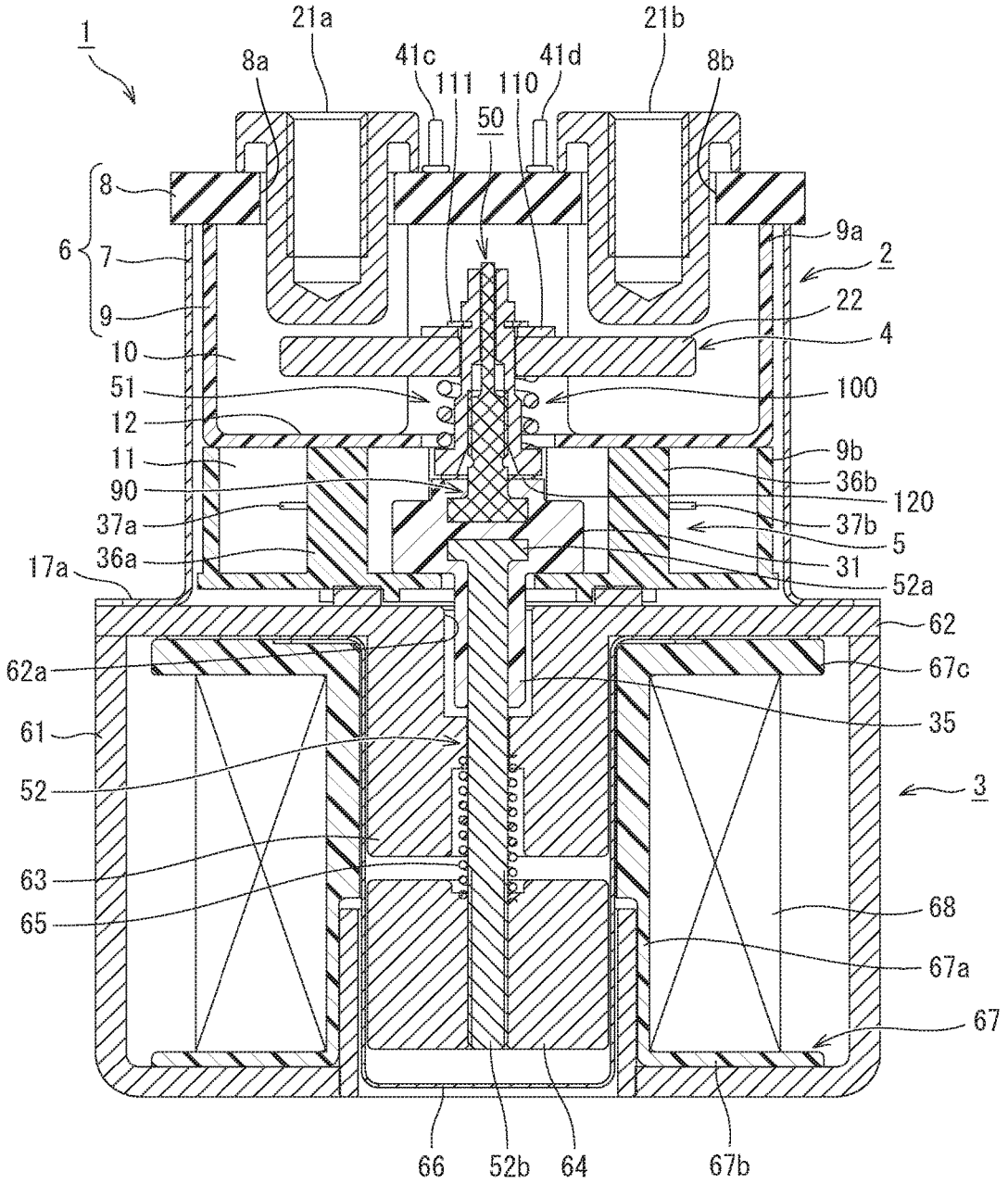
FIG. 20 illustrates a ninth embodiment of the electromagnetic contactor having the contact device according to the present invention, and is a sectional view similar to FIG. 3.
Figure 21:
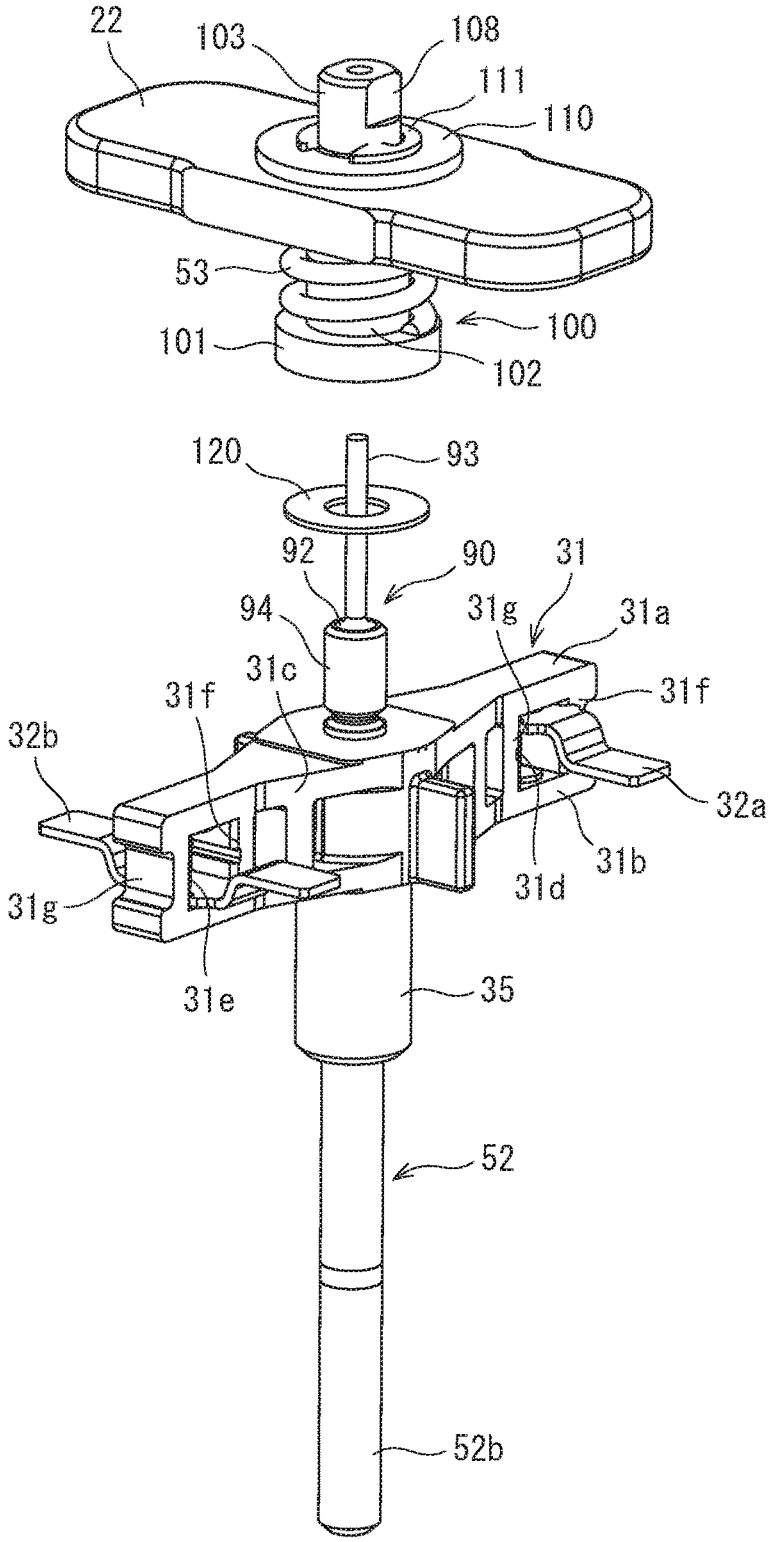
FIG. 21 is an exploded perspective view illustrating a movable shaft according to the ninth embodiment.

That is, according to the ninth embodiment, as illustrated in FIGS. 20 and 21, in the configuration of the above-described eighth embodiment, when the main movable contact support 100 is mounted on the support shaft 90, the large diameter shaft 92 of the support shaft 90 protruding from the auxiliary contact holding member 31 is first inserted into a central opening of a ring-shaped adjusting piece 120 having a predetermined thickness.

In this state, the female screw 107 of the main movable contact support 100 is screwed to the male screw 94. The main movable contact support 100 is rotated so that both of these are fastened until the lower end of the main movable contact support 100 comes into contact with the upper surface of the adjusting piece 120. In this manner, the axial position of the main movable contact support 100 is adjusted by the thickness of the adjusting piece 120. Therefore, it is possible to adjust the wipe amount of the main movable contact 22.

Here, in a case where the wipe amount of the main movable contact 22 is different from a reference value, the adjusting piece 120 is replaced with the adjusting piece having the added thickness corresponding to a difference from the reference value, or is provided with a new adjusting piece having the thickness corresponding to the difference. In this manner, it is possible to very accurately adjust the wipe amount of the main movable contact 22.

According to the ninth embodiment, similarly to the above-described eighth embodiment, the main contact support portion 51 and the auxiliary contact support portion 52 configuring the movable shaft 50 are joined to each other by the auxiliary contact holding member 31 formed of the insulating material. Accordingly, the charging unit which receives high voltage application can be housed inside the contact device 2. Therefore, it is possible to simplify the insulating countermeasure of the electromagnetic unit 3, and it is possible to miniaturize the electromagnetic unit 3.

In addition, the wipe amount of the main movable contact 22 is adjusted simply by mounting the adjusting piece 120 having a predetermined thickness. Accordingly, it is possible to easily adjust the wipe amount.

Figure 22:
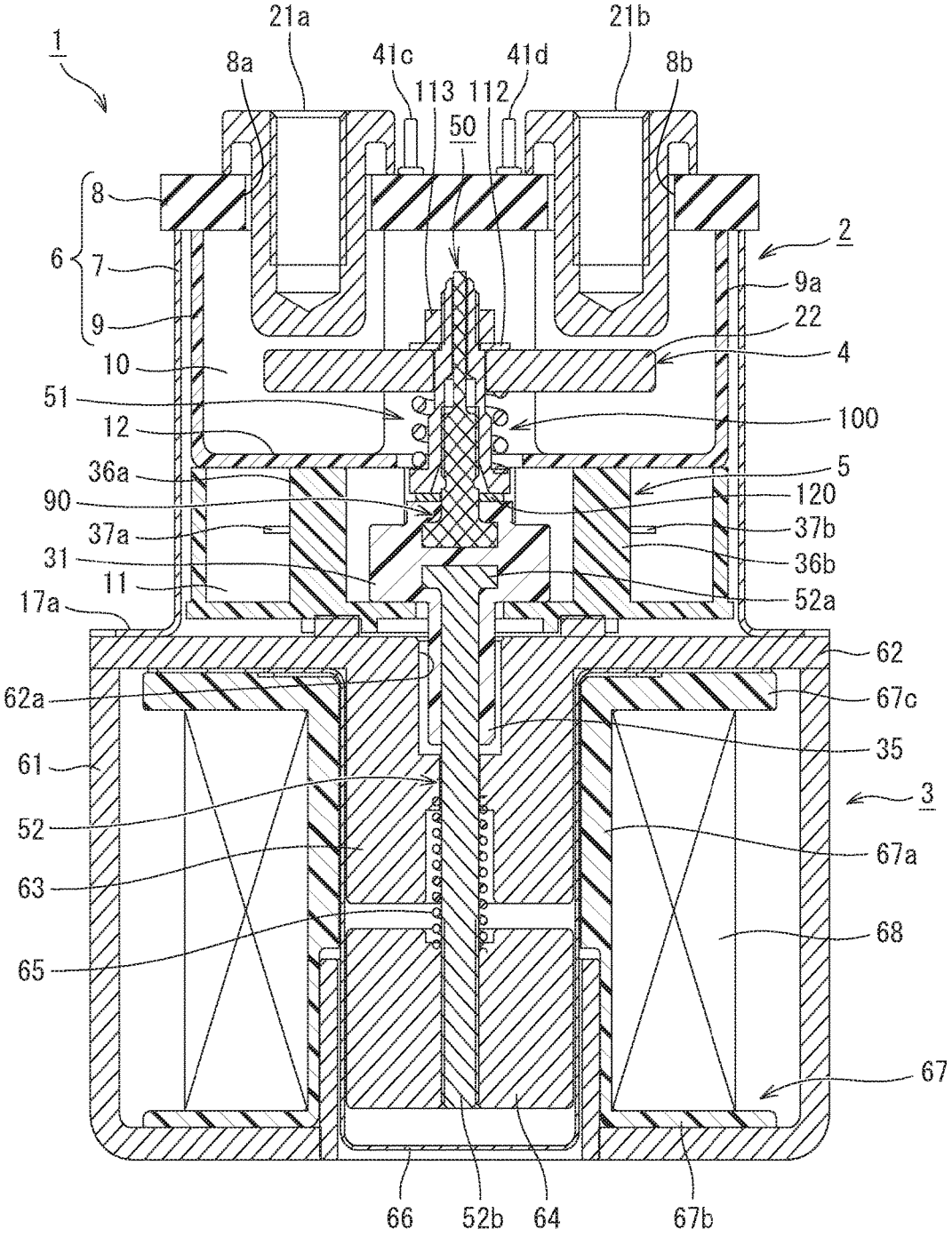
FIG. 22 illustrates a modification example of the ninth embodiment, and is a sectional view similar to FIG. 3.

In the above-described ninth embodiment, a case has been described where the upper end position of the main movable contact 22 is fixed to the main movable contact support 100 by using the E-ring 111. However, without being limited thereto, as illustrated in FIG. 22, the upper end position of the main movable contact 22 may be fixed by using the washer 112 and the nut 113.

Tenth Embodiment

Figure 23:
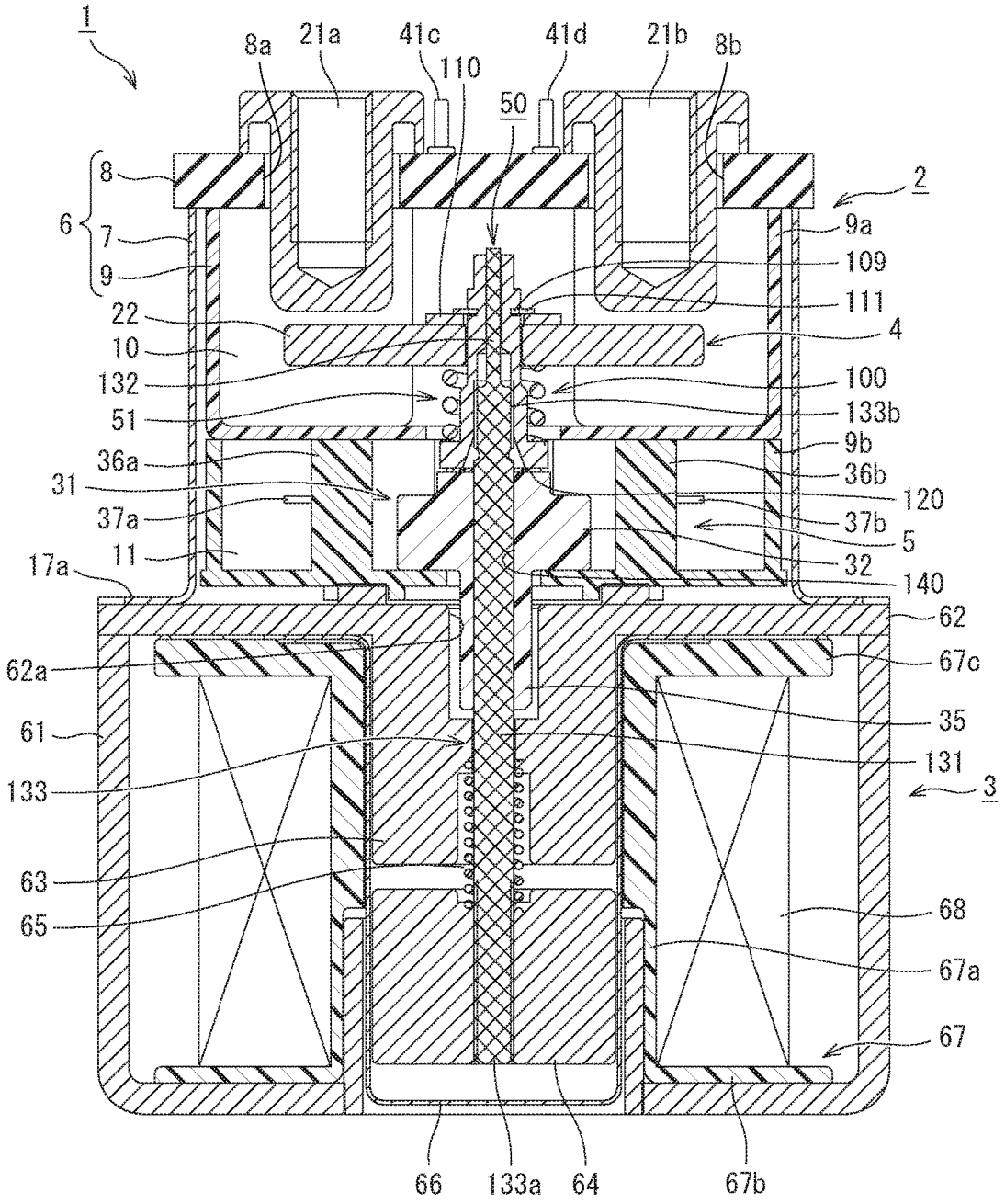
FIG. 23 illustrates a tenth embodiment of the electromagnetic contactor having the contact device according to the present invention, and is a sectional view similar to FIG. 3.
Figure 24:
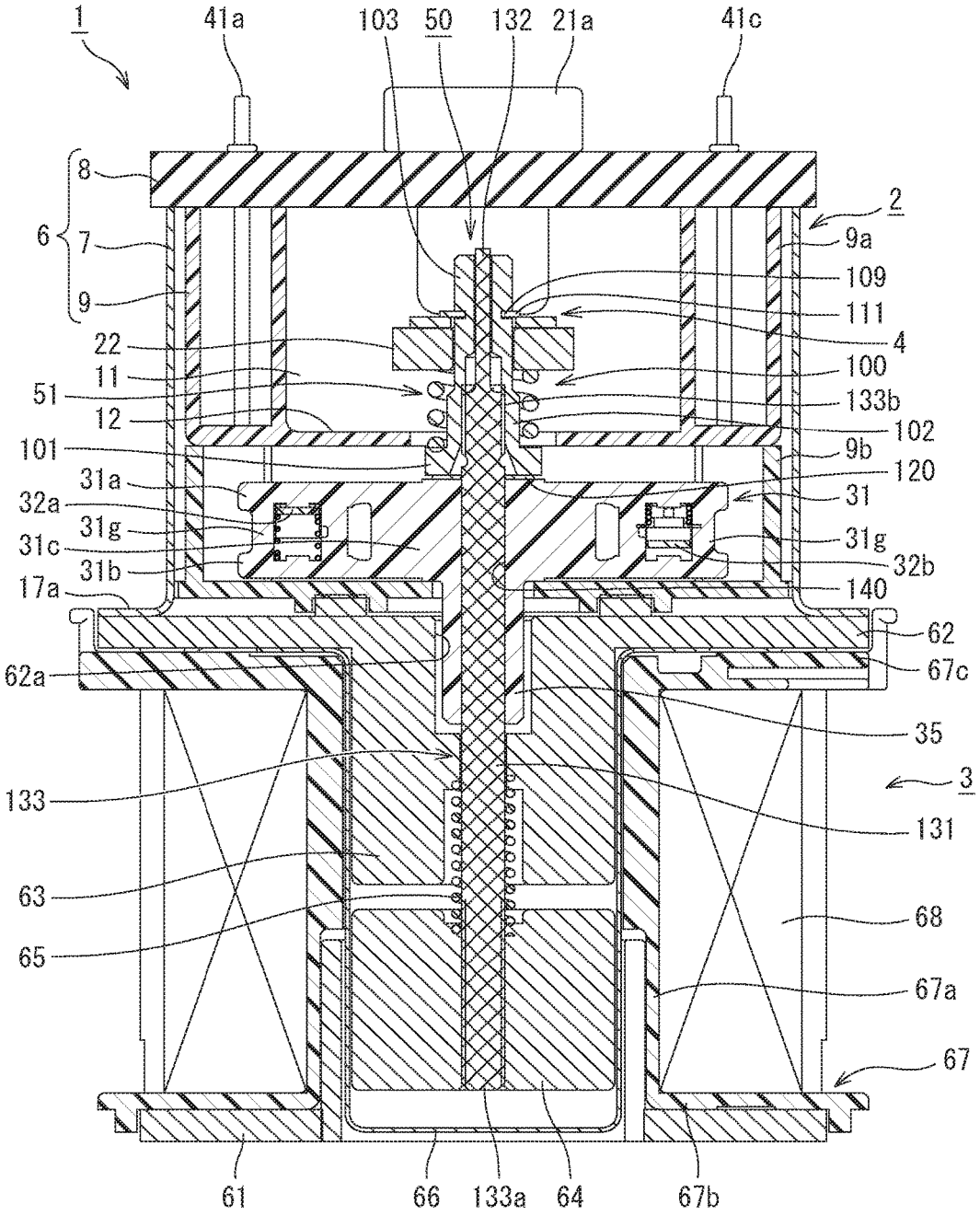
FIG. 24 illustrates the tenth embodiment, and is a sectional view similar to FIG. 4.

Next, a tenth embodiment of the electromagnetic contactor including the contact device according to the present invention will be described with reference to FIGS. 23 and 24.

According to the tenth embodiment, the support shaft of the main contact support portion and the auxiliary contact support portion configuring the movable shaft are integrally formed of an insulating material.

That is, according to the tenth embodiment, in the configuration of the above-described ninth embodiment, the support shaft 90 of the main contact support portion 51 and the auxiliary contact support portion 52 are integrally formed of an insulating member such as a hard synthetic resin material, thereby configuring a support shaft 133 configured to include a long large diameter shaft 131 and a small diameter shaft 132 connected to the distal end of the large diameter shaft 131. For example, the support shaft 133 is configured as an injection-molded product manufactured by means of injection molding.

The support shaft 133 has a male screw 133*a* screwed to a female screw 64*a* of the movable iron core 64 in an end portion opposite to the small diameter shaft 132, and has a male screw 133*b* screwed to the female screw 107 of the main movable contact support 100 on the small diameter shaft 132 side.

Therefore, the movable shaft 50 is configured to include the support shaft 133 and the main movable contact support 100.

Similarly to the above-described ninth embodiment, the main movable contact support 100 and the main movable contact 22 are connected to each other such that the upper end position in the axial direction of the main movable contact 22 is fixed by mounting the E-ring 111 on the circumferential groove 109 in a state where the main movable contact 22 presses the pressure spring 53 and the washer 110 is mounted.

The large diameter shaft 131 on the small diameter shaft 132 side is inserted into a central opening 140 formed in the columnar connection portion 31*c* of the auxiliary contact holding member 31. The support shaft 133 is integrally fixed to the auxiliary contact holding member by fixing means such as bonding and fusing.

In addition, the main movable contact support 100 is mounted on the support shaft 133 similarly to the above-described ninth embodiment. That is, in a state where the large diameter shaft 131 of the support shaft 133 protruding upward from the auxiliary contact holding member 31 is inserted into the central opening of the ring-shaped adjusting piece 120 having the predetermined thickness, the female screw 107 of the main movable contact support 100 and the male screw 133*b* of the support shaft 133 are screwed to each other, and are fastened by rotating the main movable contact support 100. In this manner, the axial position of the main movable contact support 100 is adjusted by the thickness of the adjusting piece 120. Therefore, it is possible to accurately adjust the wipe amount of the main movable contact 22.

According to the tenth embodiment, the support shaft 133 configuring the movable shaft 50 is formed of the insulating material. Accordingly, similarly to the above-described fourth embodiment, the support shaft 133 does not serve as the charging unit which receives high voltage application. The charging unit can be housed inside the contact device 2, and thus, the region for charging countermeasure can be further reduced. Therefore, it is possible to further miniaturize the configuration of the contact device 2 and the electromagnetic contactor 1 using the same, and it is possible to reduce the weight.

Moreover, the main movable contact support 100 is screwed to the support shaft 133. Accordingly, the wipe amount of the main movable contact 22 can be easily adjusted simply by rotating the main movable contact support 100 and fastening both of these after the adjusting piece 120 having the predetermined thickness is mounted thereon.

In the above-described tenth embodiment, a case has been described where the wipe amount of the main movable contact 22 is adjusted by the adjusting piece 120. However, without being limited thereto, the wipe amount of the main movable contact 22 can be adjusted by omitting the adjusting piece 120 and using a screwing amount of the main movable contact support 100.

Figure 25:
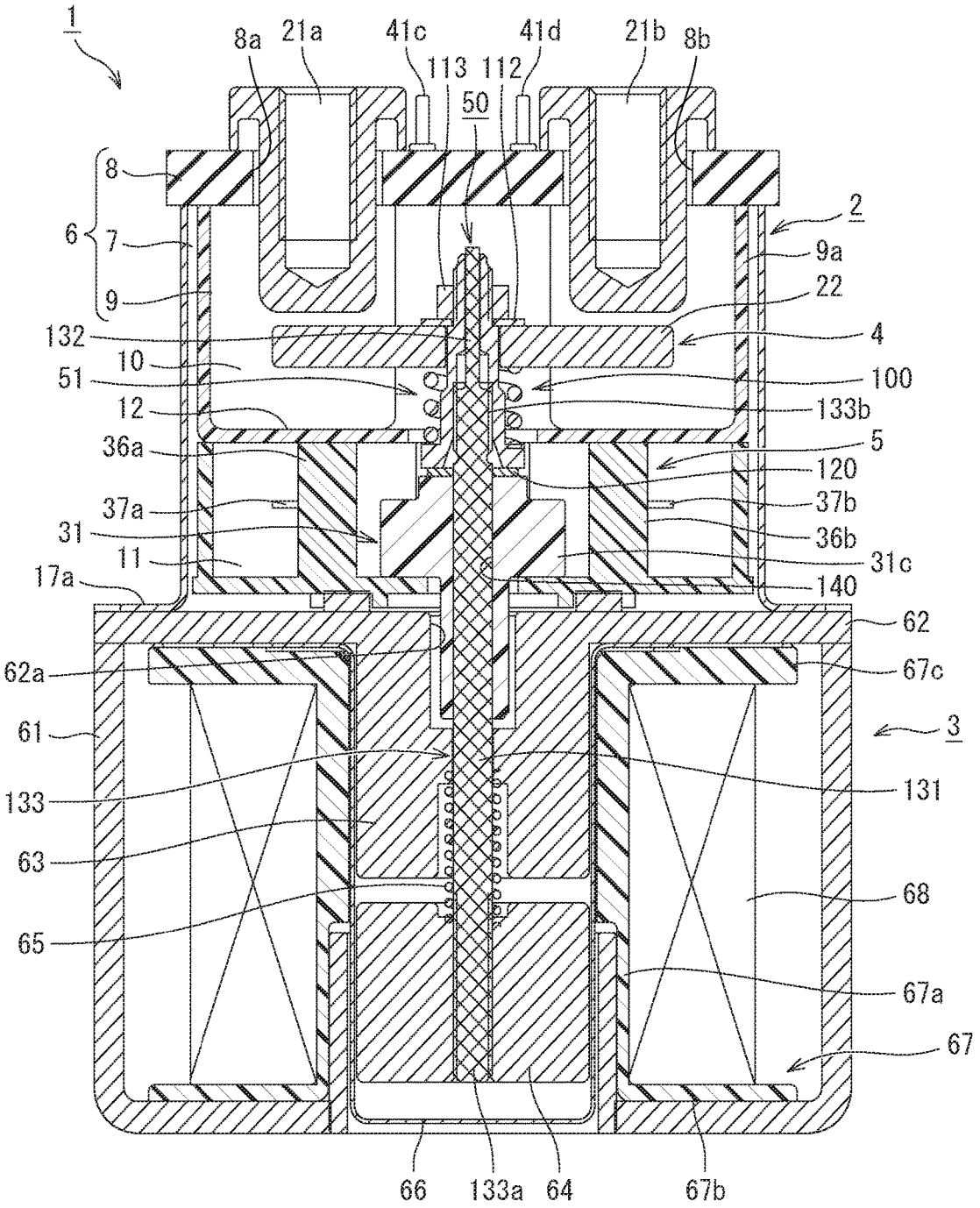
FIG. 25 illustrates a modification example of the tenth embodiment, and is a sectional view similar to FIG. 3.

In addition, in the above-described tenth embodiment, a case has been described where the upper end position of the main movable contact 22 is fixed to the main movable contact support 100 by using the E-ring 111. However, without being limited thereto, as illustrated in FIG. 25, the upper end position of the main movable contact 22 may be fixed by using the washer 112 and the nut 113.

In addition, in the above-described first to tenth embodiments, a case has been described where the auxiliary contact mechanism 5 is configured to include the make contact and the break contact. However, without being limited thereto, the auxiliary contact mechanism. 5 may be configured to include two make contacts or two break contacts.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

REFERENCE SIGNS LIST

1 . . . electromagnetic contactor, 2 . . . contact device, 3 . . . electromagnetic unit, 4 . . . main contact mechanism, 5 . . . auxiliary contact mechanism, 6 . . . contact housing portion, 7 . . . outer polygonal tubular body, 8 . . . lid, 9 . . . inner polygonal tubular body, 10 . . . main contact housing portion, 11 . . . auxiliary contact housing portion, 21*a*, 21*b* . . . main fixed contact, 22 . . . main movable contact, 31 . . . auxiliary contact holding member, 31*d*, 31*e* . . . contact holder, 32*a*, 32*b* . . . auxiliary movable contact, 37*a* to 37*d* . . . auxiliary fixed contact, 50 . . . movable shaft, 51 . . . main contact support portion, 52 . . . auxiliary contact support portion, 53 . . . pressure spring, 54 . . . washer, 55 . . . nut, 61 . . . lower magnetic yoke, 62 . . . upper magnetic yoke, 63 . . . fixed iron core, 64 . . . movable iron core, 65 . . . return spring, 70, 71 . . . adhesive, 90 . . . support shaft, 100 . . . main movable contact support, 110 . . . washer, 111 . . . e-ring, 112 . . . washer, 113 . . . nut, 120 . . . adjusting piece, 133 . . . support shaft.

The invention claimed is:

1. A contact device comprising:

a main contact mechanism that includes a pair of main fixed contacts separated from each other, a main movable contact disposed so as to be contacted with and separated from the pair of main fixed contacts, and a main contact support portion elastically supporting the main movable contact;

an auxiliary contact mechanism that is disposed at a different position from a position of the main contact mechanism, and that includes a pair of auxiliary fixed contacts separated from each other, an insulating auxiliary contact holding member supporting the main contact support portion and having an auxiliary movable contact disposed therein so as to be contacted with and separated from the pair of auxiliary fixed contacts, and an auxiliary contact support portion supporting the auxiliary contact holding member;

a contact housing portion that houses the main contact mechanism and the auxiliary contact mechanism; and a movable iron core with which the auxiliary contact support portion is fixed, wherein the auxiliary contact support portion and the main contact support portion are formed as a movable shaft to move the main movable contact and the auxiliary movable contact, and the auxiliary contact support portion and the main contact support portion are divided from each other and connected together via the auxiliary contact holding member so that the main contact support portion connects the main movable contact and the insulating auxiliary contact holding member, and the auxiliary contact support portion connects the insulating auxiliary contact holding member and the movable iron core.

2. The contact device according to claim 1, wherein the main contact support portion is formed of an insulating material.

3. The contact device according to claim 1, wherein the main contact support portion and the auxiliary contact support portion are formed of a metal material.

4. The contact device according to claim 3, wherein the main contact support portion, the auxiliary contact support portion, and the auxiliary contact holding member are configured as insert-molded products.

5. The contact device according to claim 1, wherein the auxiliary contact holding member includes adhesive fixing portions that fix the main contact support portion and the auxiliary contact support portion to the auxiliary contact holding member by using an adhesive.

6. The contact device according to claim 1, wherein opposing outer surfaces of the auxiliary contact holding member include screw fixing portions, respectively, to which a screw formed in the main contact support portion and a screw formed in the auxiliary contact support portion are screwed, respectively.

7. The contact device according to claim 6, wherein the main contact support portion includes a pressure spring that biases the main movable contact against the pair of main fixed contacts by one end of the pressure spring coming into contact with a surface of the main movable contact, which is opposite to the pair of main fixed contacts, a spring seat that receives another end of the pressure spring, and a fixing portion that fixes an axial position of the main movable contact, which is opposite to the pressure spring.

8. The contact device according to claim 6, wherein the main contact support portion includes a support shaft that is connected to the auxiliary contact holding member, and a main movable contact support that is mounted on an outer side of the support shaft, and wherein the main movable contact support includes a pressure spring that biases the main movable contact against the pair of main fixed contacts by one end of the pressure spring coming into contact with a surface of the main movable contact, which is opposite to the pair of main fixed contacts, a spring seat that receives another end of the pressure spring, and a fixing portion that fixes an axial position of the main movable contact, which is opposite to the pressure spring.

9. The contact device according to claim 1, wherein the main contact support portion includes a wipe amount adjusting portion that adjusts a contact wipe amount of the main contact mechanism.

10. The contact device according to claim 9, wherein the wipe amount adjusting portion is configured to include a male screw that is formed in a connection portion between the main contact support portion and the auxiliary contact holding member, and a female screw that is screwed to the male screw.

11. The contact device according to claim 9, wherein the wipe amount adjusting portion is configured to include a male screw for mounting a pressure spring, and a nut serving as a fixing portion that is screwed to the male screw.

12. The contact device according to claim 9, wherein the wipe amount adjusting portion is configured to include a spacer that is interposed between one end of a pressure spring and a spring seat.

13. The contact device according to claim 12, wherein the wipe amount adjusting portion is configured to include a male screw that is formed in a support shaft, and a female screw that is formed on an inner surface of a main movable contact support.

14. The contact device according to claim 12, wherein the wipe amount adjusting portion is configured to include an adjusting ring into which a support shaft is inserted so as to be interposed between the auxiliary contact holding member and a main movable contact support.

15. The contact device according to claim 12, wherein the wipe amount adjusting portion is configured to include an adjusting ring into which a support shaft is inserted so as to be interposed between the auxiliary contact holding member and a main movable contact support, and a nut serving as a fixing portion that is screwed to a male screw formed in the support shaft.

16. An electromagnetic contactor comprising:

the contact device according to claim 1, wherein the electromagnetic contactor includes an electromagnetic unit that moves the movable iron core.

17. The electromagnetic contactor according to claim 16, wherein the electromagnetic unit includes a fixed iron core that faces the movable iron core, a control coil that is wound around the fixed iron core, and a magnetic yoke that surrounds an outer peripheral side of the control coil, wherein the movable iron core connected to the movable shaft is disposed inside a through-hole funned in a central portion of an upper magnetic yoke which forms the magnetic yoke, and wherein a periphery of the movable iron core is covered with a sealing cap.

18. The contact device according to claim 1, wherein the main contact support portion, the auxiliary contact support portion, and the auxiliary contact holding member are formed separately from each other, and the auxiliary contact holding member is formed of an insulating material to ensure insulation between the main contact support portion and the auxiliary contact support portion.

19. The contact device according to claim 1, wherein the contact housing portion includes an outer tubular body having openings at two ends thereof, a lid disposed on the outer tubular body to close one of the openings, and an inner tubular body disposed inside the outer tubular body, the inner tubular body includes a main contact housing portion housing the main contact mechanism, and an auxiliary contact housing portion disposed under the main contact housing portion and housing the auxiliary contact mechanism, and the auxiliary contact housing portion includes fixed contact holders facing each other to form a space therebetween and the pair of auxiliary fixed contacts attached to the fixed contact holders, and the auxiliary contact holding member is arranged in the space between the fixed contact holders.

20. The contact device according to claim 1, wherein the insulating auxiliary contact holding member includes a cylindrical extending portion protruding from a lower surface of the auxiliary contact holding member, in which the auxiliary contact support portion is inserted to prevent the auxiliary contact support portion from being tilted relative to the insulating auxiliary contact holding member.

* * * * *